US011953024B1

(12) United States Patent
Sheth et al.

(10) Patent No.: US 11,953,024 B1
(45) Date of Patent: Apr. 9, 2024

(54) CENTRIFUGAL PUMP STAGE DIFFUSER

(71) Applicant: Halliburton Energy Services, Inc., Houston, TX (US)

(72) Inventors: Ketankumar K. Sheth, Tulsa, OK (US); Donn J. Brown, Tulsa, OK (US); Gerald Glen Goshorn, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/973,997

(22) Filed: Oct. 26, 2022

(51) Int. Cl.

| | |
|---|---|
| ***F04D 29/44*** | (2006.01) |
| ***E21B 43/12*** | (2006.01) |
| ***F04D 1/06*** | (2006.01) |
| ***F04D 13/08*** | (2006.01) |
| ***F04D 29/62*** | (2006.01) |

(52) U.S. Cl.
CPC ..... *F04D 29/448* (2013.01); *E21B 43/128* (2013.01); *F04D 1/06* (2013.01); *F04D 13/086* (2013.01); *F04D 29/628* (2013.01)

(58) Field of Classification Search
CPC ..... F04D 29/444; F04D 29/448; F04D 13/10; F04D 31/00; E21B 43/128
See application file for complete search history.

(56) References Cited

U.S. PATENT DOCUMENTS 4,877,370 A * 10/1989 Nakagawa ..... F04D 29/462 415/208.4
5,709,531 A 1/1998 Nishida et al.
6,676,366 B2 1/2004 Kao
6,893,207 B2 5/2005 Kao
7,905,703 B2 * 3/2011 Cruickshank ..... F04D 17/122 415/199.2
8,602,728 B2 * 12/2013 Swiatek ..... F04D 29/666 415/208.4
2011/0194931 A1 8/2011 Swiatek et al.
2014/0178190 A1 6/2014 Gahlot et al.
2014/0216720 A1 8/2014 Wang et al.
2019/0017518 A1 1/2019 Brown et al.

OTHER PUBLICATIONS

Foreign Communication from Related Application—International Search Report and Written Opinion of the International Searching Authority, International Application No. PCT/US2023/029917, dated Nov. 28, 2023, 11 pages.

* cited by examiner

*Primary Examiner* — J. Todd Newton
*Assistant Examiner* — Jackson N Gillenwaters
(74) *Attorney, Agent, or Firm* — Conley Rose, P.C.; Rodney B. Carroll

(57) ABSTRACT

A submersible pump assembly. The submersible pump assembly comprises a motor comprising a first drive shaft; a seal section comprising a second drive shaft that is coupled to the first drive shaft of the motor; and a centrifugal pump assembly comprising a third drive shaft that is coupled to the second drive shaft of the seal section and a plurality of pump stages, wherein each pump stage comprises an impeller coupled to the third drive shaft and a diffuser retained by a housing of the centrifugal pump assembly, wherein the diffuser of each pump stage comprises a first plurality of vanes each having a first axial length and a second plurality of vanes each disposed between a pair of vanes of the first plurality of vanes and each having a second axial length, wherein the second axial length is less than the first axial length.

24 Claims, 11 Drawing Sheets

CENTRIFUGAL PUMP STAGE DIFFUSER

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Electric submersible pumps (hereafter "ESP" or "ESPs") may be used to lift production fluid in a wellbore. Specifically, ESPs may be used to pump the production fluid to the surface in wells with low reservoir pressure. ESPs may be of importance in wells having low bottomhole pressure or for use with production fluids having a low gas/oil ratio, a low bubble point, a high water cut, and/or a low API gravity. Moreover, ESPs may also be used in any production operation to increase the flow rate of the production fluid to a target flow rate.

Generally, an ESP comprises an electric motor, a seal section, a pump intake, and one or more pumps (e.g., a centrifugal pump). These components may all be connected with a series of shafts. For example, the pump shaft may be coupled to the motor shaft through the intake and seal shafts. An electric power cable provides electric power to the electric motor from the surface. The electric motor supplies mechanical torque to the shafts, which provide mechanical power to the pump. Fluids, for example reservoir fluids, may enter the wellbore where they may flow past the outside of the motor to the pump intake. These fluids may then be produced by being pumped to the surface inside the production tubing via the pump, which discharges the reservoir fluids into the production tubing.

The reservoir fluids that enter the ESP may sometimes comprise a gas fraction. These gases may flow upwards through the liquid portion of the reservoir fluid in the pump. The gases may even separate from the other fluids when the pump is in operation. If a large volume of gas enters the ESP, or if a sufficient volume of gas accumulates on the suction side of the ESP, the gas may interfere with ESP operation and potentially prevent the intake of the reservoir fluid. This phenomenon is sometimes referred to as a "gas lock" because the ESP may not be able to operate properly due to the accumulation of gas within the ESP.

Other oilfield applications may likewise rely on centrifugal pumps. The centrifugal pump may be turned by a hydraulic turbine located downhole or by a pneumatic turbine located downhole. A centrifugal pump may be disposed at the surface in a horizontal position and be driven by an electric motor, a hydraulic turbine, or a pneumatic turbine, for example to pump salt water into an injection well.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
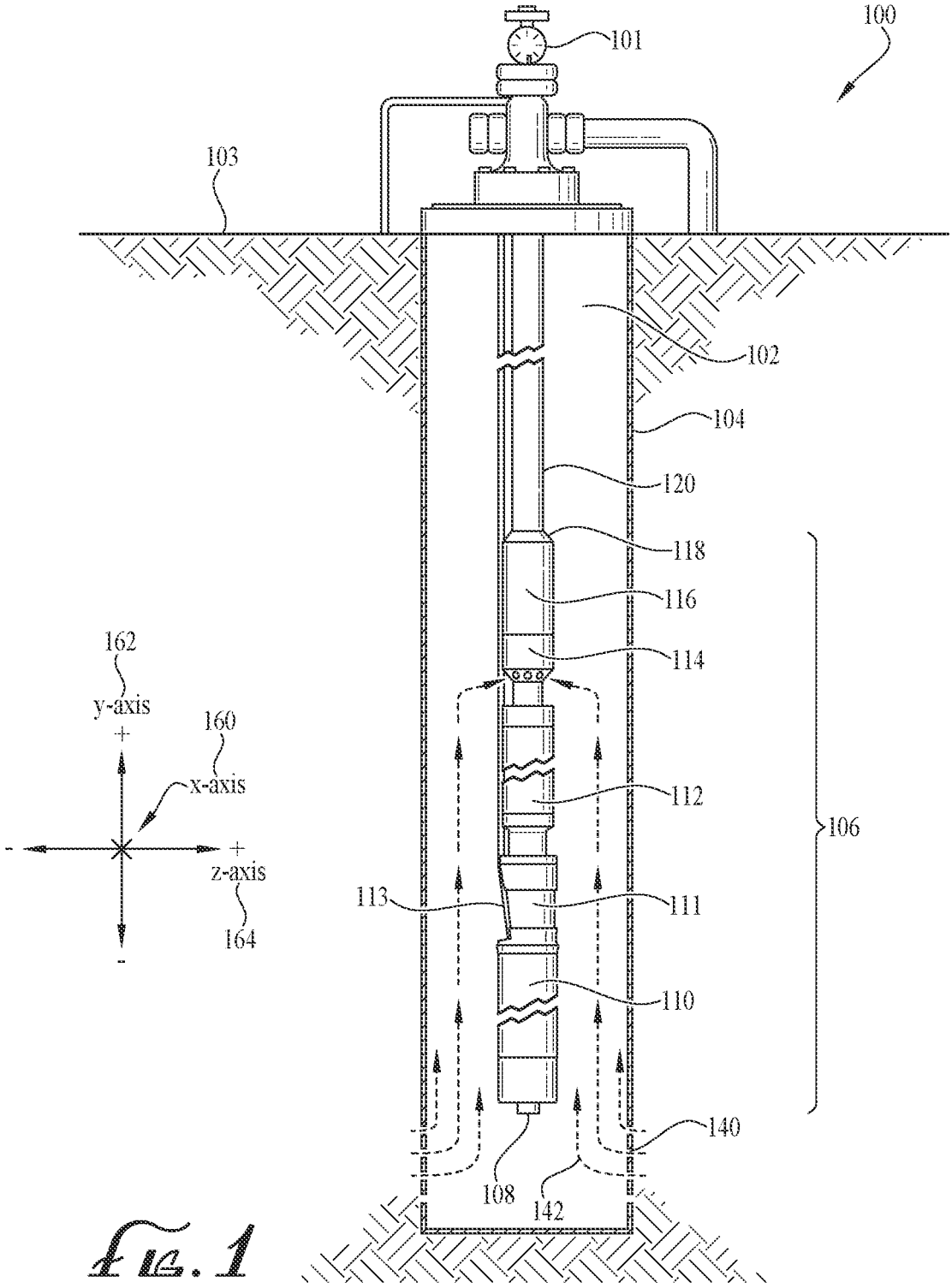
FIG. 1 is an illustration of an electric submersible pump (ESP) assembly disposed in a wellbore according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "upstream," "downstream, p," "down," "uphole," and "downhole" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" and "downhole" are directed counter to the direction of flow of well fluid, towards the source of well fluid. "Up" and "uphole" are directed in the direction of flow of well fluid, away from the source of well fluid. "Fluidically coupled" means that two or more components have communicating internal passageways through which fluid, if present, can flow. A first component and a second component may be "fluidically coupled" via a third component located between the first component and the second component if the first component has internal passageway(s) that communicates with internal passageway(s) of the third component, and if the same internal passageway(s) of the third component communicates with internal passageway(s) of the second component. As used herein, the term "about" when referring to a measured value or fraction means a range of values +/−5% of the nominal value stated. Thus, "about 1 inch," in this sense of "about," means the range 0.95 inches to 1.05 inches, and "about 5000 PSI," in this sense of "about," means the range 4750 PSI to 5250 PSI. Thus, the fraction "about 8/10s" Means the Range 76/100s to 84/100s.

Centrifugal pumps are desirably operated within a particular range of fluid flow rate and pump head at which a given pump operates efficiently and reliably. If operated outside of its particular range, a centrifugal pump may be inefficient and may have a shortened service life. Not wishing to be limited by theory, it is thought that one of the causes of centrifugal pump inefficiency outside the range of efficient operation is separation of fluid flow from surfaces of the axial flow passages of the diffuser in the centrifugal pump stages, resulting in eddy currents that effectively reduce the cross-sectional area of the flow passages of the diffuser. Typically, flow passages of a diffuser in a pump stage of a centrifugal pump increase in cross-sectional area (e.g., orthogonal to the axis of the centrifugal pump) from an inlet of the diffuser to an outlet of the diffuser, pursuant to converting kinetic energy of the fluid to pressure energy by reducing the flow velocity of the fluid and increasing the pressure of the fluid. If the fluid flow separates from the surfaces defining the axial flow passages of the diffuser, a stagnant area develops at those surfaces and extends outwards that effectively decreases the cross-sectional area of the flow passage, thereby reducing the efficiency of the centrifugal pump outside the operating range.

The current disclosure teaches new diffuser structures that can expand the range of efficient operation of a centrifugal pump. In one embodiment, one or more truncated vanes are disposed between full-length vanes in the diffuser to reduce separation of fluid flow from the surfaces of the full-length vanes. As used herein, the term "truncated vane" is not intended to imply that the subject vane was made full-length and then cropped or curtailed in length, though as an implementation detail they may be fabricated in that way. The term "truncated vane" simply means the subject vane is shorter in axial length than a nominally full-length vane. In another embodiment, a ring vane is disposed within the diffuser between a hub structure of the diffuser and a shroud structure of the diffuser to reduce separation of fluid flow from the surfaces of the hub and from the surfaces of the shroud. The new diffuser structures taught herein may be particularly advantageous in lifting well fluids that are a mix of gas phase fluid and liquid phase fluid (e.g., two state fluids) and in lifting liquid phase fluids that have a low bubble point pressure or are near the liquid-gas critical point. For example, fluid flow separation from the surfaces of diffuser vanes of a centrifugal pump may be a common problem in gassy applications. Not wishing to be bound by theory, it is thought that gas in a two-phase fluid mixture may separate on one or more surface of a diffuser flow passage due to lower kinetic energy of the gas-phase portion of the fluid mixture, and this separated gas forms a stagnant region in the diffuser flow passage that diminishes the efficiency of the diffuser and hence of the pump, because the cross-sectional area of the diffuser flow passages has effectively been reduced by these stagnant areas.

Turning now to FIG. 1 a well site environment 100, according to one or more aspects of the disclosure, is described. The well site environment 100 comprises a wellbore 102 that is at least partially cased with casing 104. As depicted in FIG. 1, the wellbore 102 is substantially vertical, but the electric submersible pump (ESP) assembly 106 described herein also may be used in a wellbore 102 that has a deviated or horizontal portion. The well site environment 100 may be at an on-shore location or at an off-shore location. The ESP assembly 106 in an embodiment comprises an optional sensor package 108, an electric motor 110, a motor head 111 that couples the electric motor 110 to a seal unit 112, a fluid intake 114, and a centrifugal pump assembly 116. In an embodiment, the electric motor 110 may be replaced by a hydraulic turbine, a pneumatic turbine, a hydraulic motor, or an air motor, and in this case the assembly 106 may be referred to as a submersible pump assembly. In an embodiment, the ESP assembly 106 may further comprise a gas separator assembly (not shown) that may be located between the fluid intake 114 and the centrifugal pump assembly 116. In an embodiment, the fluid intake 114 may be integrated into a downhole end of the optional gas separator. In an embodiment, the fluid intake 114 may be integrated into a downhole end of the centrifugal pump assembly 116.

The centrifugal pump assembly 116 may couple to a production tubing 120 via a connector 118. An electric cable 113 may attach to the electric motor 110 and extend to the surface 103 to connect to an electric power source. In an embodiment, where the electric motor 110 is replaced by a hydraulic turbine or a hydraulic motor, the electricable 113 may be replaced by a hydraulic power supply line. In an embodiment, where the electric motor 110 is replaced by a pneumatic turbine or an air motor, the electric cable 113 may be replaced by a pneumatic power supply line. The casing 104 and/or wellbore 102 may have perforations 140 that allow well fluid 142 to pass from the subterranean formation through the perforations 140 and into the wellbore 102. In some contexts, well fluid 142 may be referred to as reservoir fluid.

The well fluid 142 may flow uphole towards the ESP assembly 106 and into the fluid intake 114. The well fluid 142 may comprise a liquid phase fluid. The well fluid 142 may comprise a gas phase fluid mixed with a liquid phase fluid. The well fluid 142 may comprise only a gas phase fluid (e.g., simply gas). Over time, the gas-to-fluid ratio of the well fluid 142 may change dramatically. For example, in the circumstance of a horizontal or deviated wellbore, gas may build up in high points in the roof of the wellbore and after accumulating sufficiently may "burp" out of these high points and flow downstream to the ESP assembly 106 as what is commonly referred to as a gas slug. Thus, immediately before a gas slug arrives at the ESP assembly 106, the gas-to-fluid ratio of the well fluid 142 may be very low (e.g., the well fluid 142 at the ESP assembly 106 is mostly liquid phase fluid); when the gas slug arrives at the ESP assembly 106, the gas-to-fluid ratio is very high (e.g., the well fluid 142 at the ESP assembly 106 is entirely or almost entirely gas phase fluid); and after the gas slug has passed the ESP assembly 106, the gas-to-fluid ratio may again be very low (e.g., the well fluid 142 at the ESP assembly 106 is mostly liquid phase fluid).

Under normal operating conditions (e.g., well fluid 142 is flowing out of the perforations 140, the ESP assembly 106 is energized by electric power, the electric motor 110 is turning, and a gas slug is not present at the ESP assembly 106), the well fluid 142 enters the fluid intake 114, flows into the centrifugal pump assembly 116, and the centrifugal pump assembly 116 flows the fluid through the connector 118 and up the production tubing 120 to a wellhead 101 at the surface 103. The centrifugal pump assembly 116 provides pumping pressure or pump head to lift the well fluid 142 to the surface. The well fluid 142 may comprise hydrocarbons such as crude oil and/or natural gas. The well fluid 142 may comprise water. In a geothermal application, the well fluid 142 may comprise hot water. An orientation of the wellbore 102 and the ESP assembly 106 is illustrated in FIG. 1 by an x-axis 160, a y-axis 162, and a z-axis 164.

Figure 2:
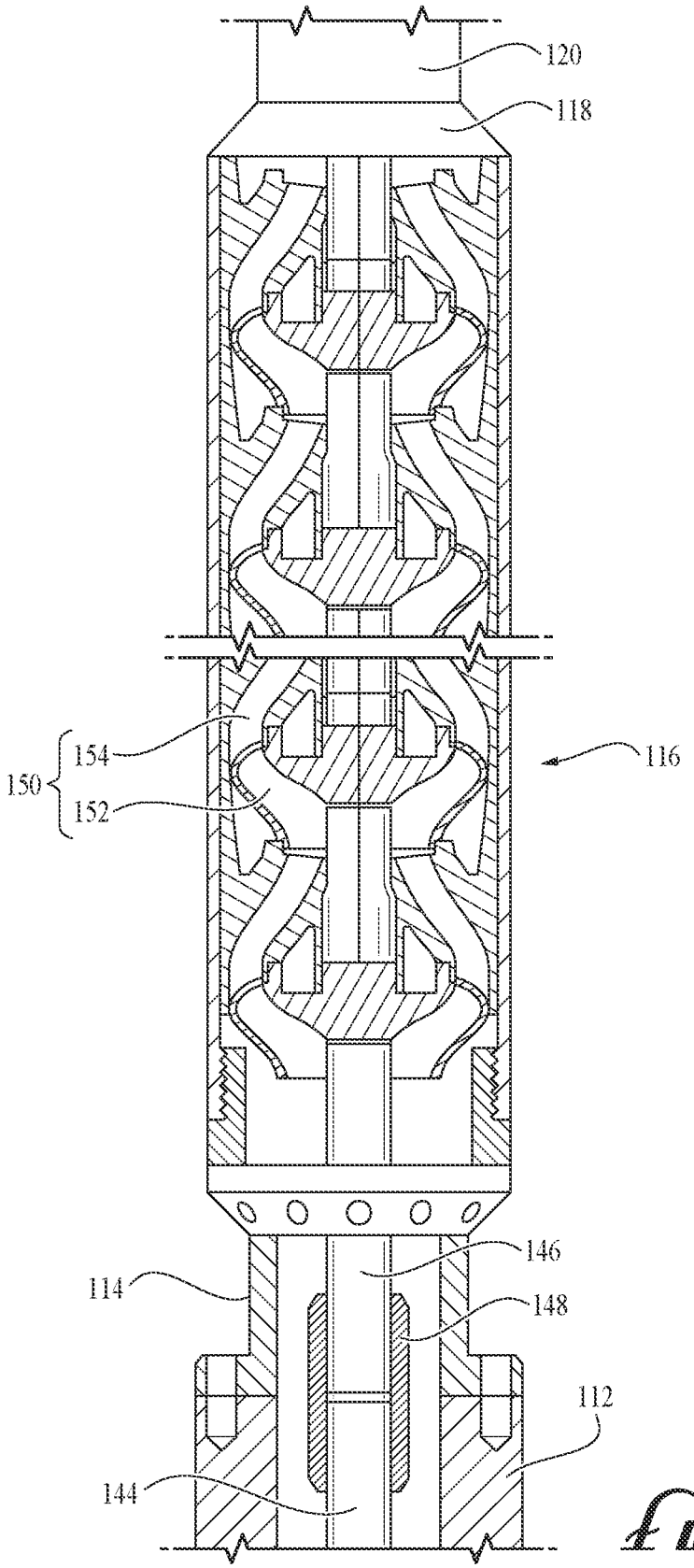
FIG. 2 is an illustration of a centrifugal pump assembly according to an embodiment of the disclosure.

Turning now to FIG. 2, further details of the centrifugal pump assembly 116 are described. The view of FIG. 2 is a cross-section view of the centrifugal pump assembly 116 and illustrates a mixed flow pump configuration. In other embodiments, however, the centrifugal pump assembly 116 may be a radial flow pump configuration or an axial flow pump configuration rather than a mixed flow pump configuration. A downhole end of the fluid intake 114 may be bolted to a head of the seal section 112. An uphole end of the fluid intake 114 may be threadingly connected to a housing of the centrifugal pump assembly 116. Alternatively, the uphole end of the fluid intake 114 may be bolted to the centrifugal pump assembly 116. A drive shaft 144 of the seal section 112 may be coupled to a drive shaft of the electric motor 110 and receive rotational power from the drive shaft of the electric motor 110. An uphole end of the drive shaft 144 may be coupled via a coupling shell 148 to a downhole end of a drive shaft 146 of the centrifugal pump assembly 116, and the drive shaft 146 of the centrifugal pump assembly 116 may receive rotational power from the electric motor 110 via the drive shaft 144 of the seal section 112.

In an embodiment, the centrifugal pump assembly 116 comprises one or more centrifugal pump stages 150, where each pump stage 150 comprises an impeller 152 that is mechanically coupled to the drive shaft 146 of the centrifugal pump assembly 116 and a corresponding diffuser 154 that is stationary and retained by a housing of the centrifugal pump assembly 116. The impellers 152 coupled to the drive shaft 146 rotate as the electric motor 110 provides rotational power to the drive shaft 146. The turning impeller 152 of each pump stage 150 does work on the well fluid 142 and increases the kinetic energy of the well fluid 142 it receives from the outlet of the downhole diffuser 154. The diffuser 154 at each pump stage changes the direction of the well fluid 142 received from the downhole impeller 152 and converts at least some of the kinetic energy of the well fluid 142 into pressure energy. Thus, as the well fluid 142 flows through the multiple pump stages 150 the pressure of the well fluid 142 is increased.

In an embodiment, the impellers 152 may comprise a keyway that mates with a corresponding keyway on the drive shaft 146 of the centrifugal pump assembly 116 and a key may be installed into the two keyways, wherein the impeller 152 may be mechanically coupled to the drive shaft 146 of the centrifugal pump assembly 116, In an embodiment, the centrifugal pump assembly 116 may comprise 2 pump stages 150, three pump stages 150, five pump stages 150, ten pump stages 150, twenty pump stages 150, thirty pump stages 150, forty pump stages 150, fifty pump stages 150, seventy pump stages 150, one hundred pump stages 150, or more pump stages 150.

Figure 3A:
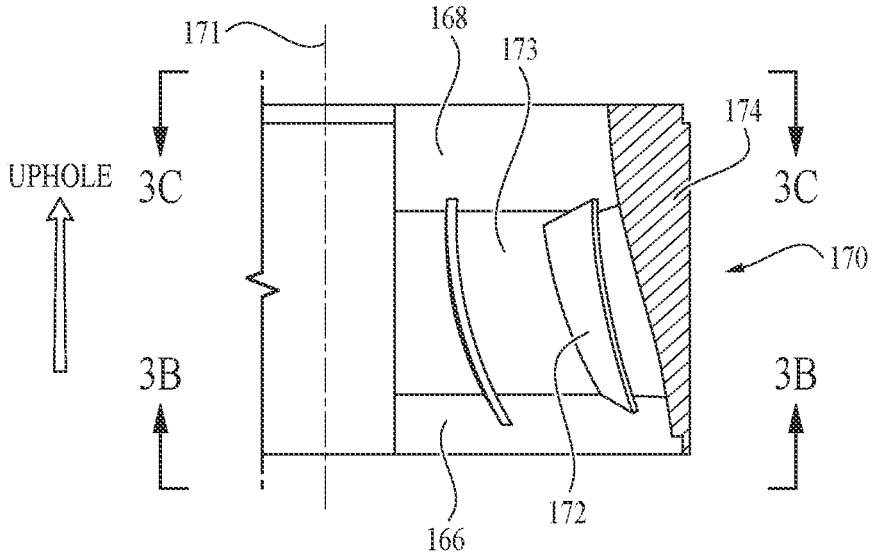
FIG. 3A is an illustration of a diffuser of a centrifugal pump stage according to an embodiment of the disclosure.
Figure 3B:
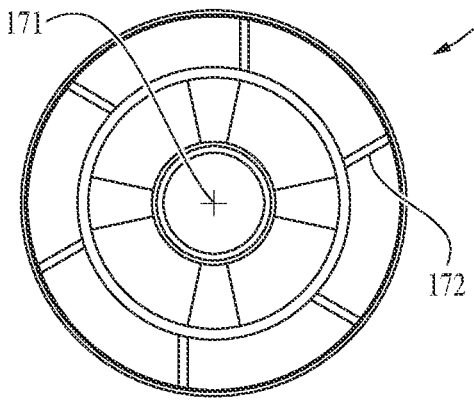
FIG. 3B is an illustration of a diffuser of a centrifugal pump stage looking uphole into an inlet of the diffuser according to an embodiment of the disclosure.

Turning now to FIG. 3A, FIG. 3B, and FIG. 30, an exemplary diffuser 170 is described. The diffuser 170 has a centerline axis 171 that is substantially coincident with a centerline of the centrifugal pump assembly 116, the seal section 112, and the electric motor 110. The diffuser 170 has a hub structure 173 at its center which surrounds the drive shaft 146 when the diffuser 170 is installed in the centrifugal pump assembly 116. The diffuser 170 has a shroud structure 174 forming an outside wall of the diffuser 170. The diffuser 170 defines an inlet 166 at a downhole open end and an outlet 168 at an uphole open end. The diffuser 170 has a plurality of vanes 172 that each extend radially outward from the hub structure 173 to the shroud structure 174. In an embodiment, the vanes 172 are each spaced about an equal angular distance apart, rotated around the centerline axis 171. The vanes 172 are each of one-piece construction In the cut-away view of FIG. 3A, the outside ends of the vanes 172 are disconnected to show their profile and angle, but it understood that the vanes 172 attach to the outside of the hub structure 173 at one side and attach to the inside of the shroud structure 174 at their other side. The diffuser 170 defines a plurality of flow passages bounded radially by the outward facing side of the hub structure 173 (e.g., facing radially away from the centerline 171), by the inward facing side of the shroud structure 174, and by two of the vanes 172.

In an embodiment, the diffuser 170 is formed of metal material. The diffuser 170 may be manufactured by casting and finishing. The diffuser 170 may be manufactured by a 3-D printing process. The diffuser 170 may be made of more than one piece and made from more than one kind of material. In an embodiment, the diffuser 170 may be made of plastic material or of ceramic material. In an embodiment, the diffuser 170 may e made of two different kinds of metal, a combination of metal and plastic, a combination of metal and ceramic, a combination of plastic and ceramic, or a combination of metal, plastic, and ceramic. FIG. 3B shows a view looking uphole into the inlet 166 of the diffuser 170. FIG. 30 shows a view looking downhole into the outlet 168 of the diffuser 170.

Figure 3C:
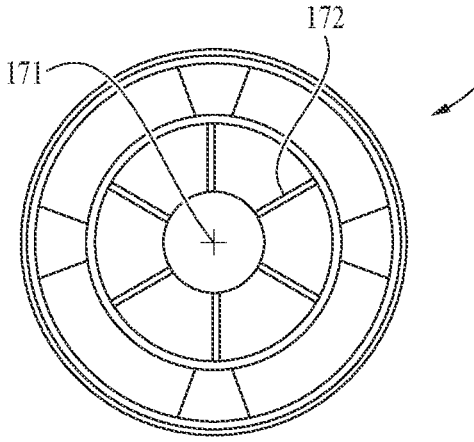
FIG. 3C is an illustration of a diffuser of a centrifugal pump stage looking downhole into an outlet of the diffuser according to an embodiment of the disclosure.
Figure 3E:
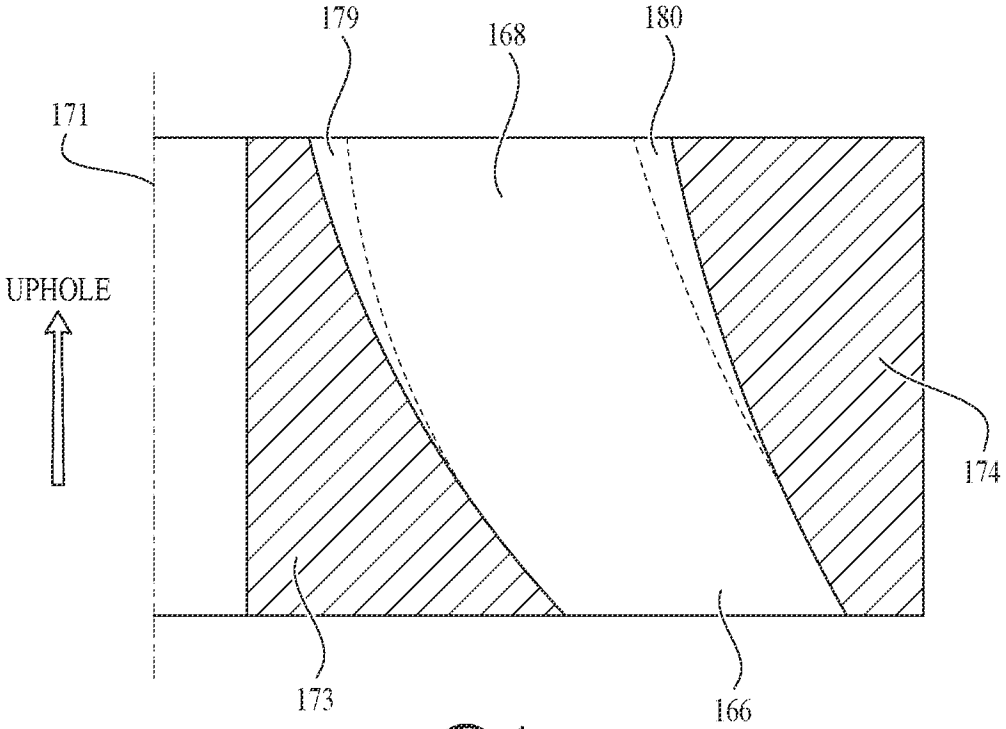
FIG. 3E is a cross-section view of a portion of a diffuser of a centrifugal pump stage according to an embodiment of the disclosure.
Figure 3D:
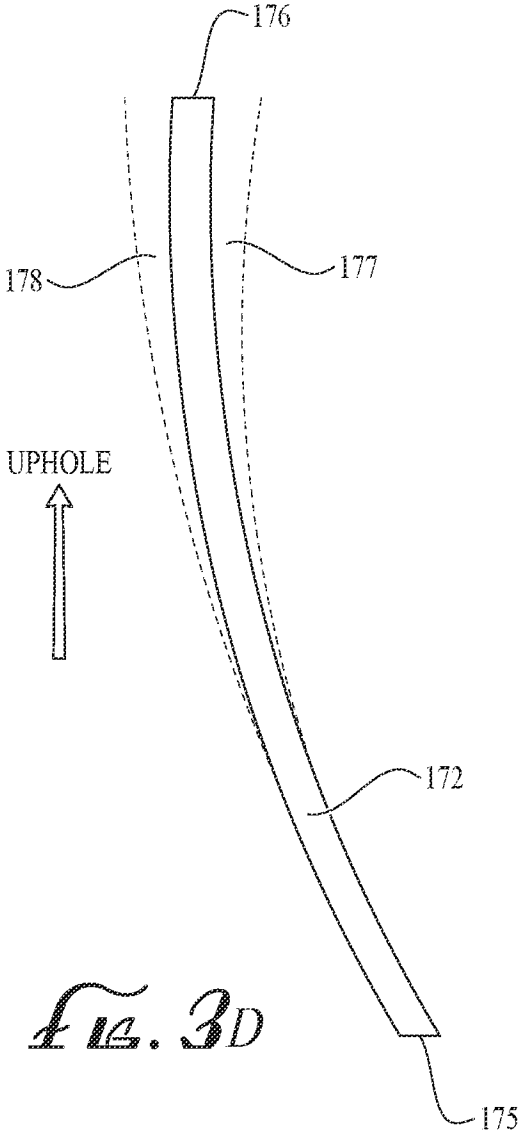
FIG. 3D is an illustration of a vane of a diffuser of a centrifugal pump stage according to an embodiment of the disclosure.

Turning now to FIG. 3D, a cross-section view of the vane 172 of the diffuser 170 is described. The vane 172 defines a leading edge 175 at the downhole end of the vane 172 and a trailing edge 176 of the vane 172 at the uphole end of the vane 172. As fluid flows uphole past the vane 172 in the diffuser 170, a high-pressure side of the vane 172 is the left side of the vane 172 as illustrated in FIG. 3D and a low-pressure side of the vane 172 is the right side of the vane 172 as illustrated in FIG. 3D. When fluid flow separates from the surface of the vane 172 during operation, it is likely to separate in the region 177 on the low-pressure side of the vane 172 and/or to separate in the region 178 on the high-pressure side of the vane 172. Analysis of the vane 172 using a computational flow dynamics (CFD) tool can more specifically identify regions of likely fluid flow separation on surfaces of the vane 172 during various fluid flow regimes.

In an embodiment, the vanes 172 define a concave shape on one side (the side proximate to the region 177) and a convex shape on the opposite side (the side proximate to the region 178) when viewed from their outside edges looking radially inward towards the hub structure 173. In an embodiment, the vane 172 proximate the leading edge 175 makes an angle relative to the centerline 171 that lessens as the vane 172 proceeds from the leading edge 175 to the trailing edge 176 such that the vane 172 proximate the trailing edge 176 is substantially parallel to the centerline 171. While in FIG. 3A and FIG. 3D, the vanes 172 are illustrated as slanted from right to left from downhole to uphole, in another embodiment, the vanes 172 may slant in the opposite sense, from left to right from downhole to uphole, based on the rotational direction of the impeller associated with the diffuser 170.

As best seen in FIG. 3A, in an embodiment, an outside edge of the leading edge 175 where it attaches to the inside of the shroud structure 174 is further downhole than an inside edge of the leading edge 175 where it attaches to the outside of the hub structure 173. In an embodiment, an outside edge of the trailing edge 176 is further uphole than an inside edge of the trailing edge 176 where it attaches to the outside of the hub structure 173.

Turning now to FIG. 3E, a cross-section view of the hub structure 173 and the shroud structure 174 of the diffuser 170 is described. When fluid flow separates from the outward facing surface of the hub structure 173, it is likely to separate in the region 179. When fluid flow separates from the inward facing surface of the shroud structure 174, it is likely to separate in the region 180. Analysis of the hub structure 173 and of the shroud structure 174 using a CFD tool can more specifically identify regions of likely fluid flow separation on outward facing surface of the hub structure 173 and on the inward facing surface of the shroud structure 174 during various fluid flow regimes.

Figure 4A:
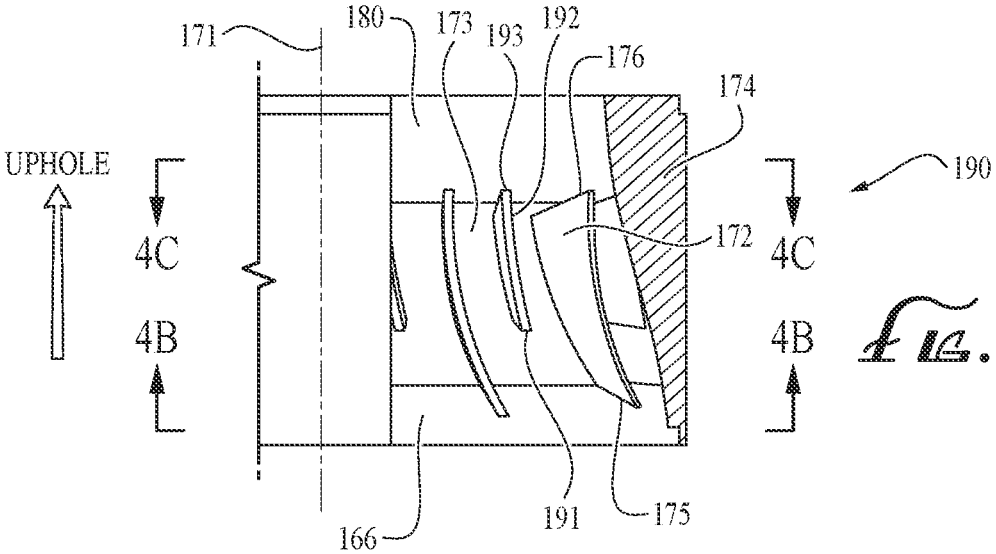
FIG. 4A is an illustration of a diffuser of a centrifugal pump stage according to an embodiment of the disclosure.
Figure 4B:
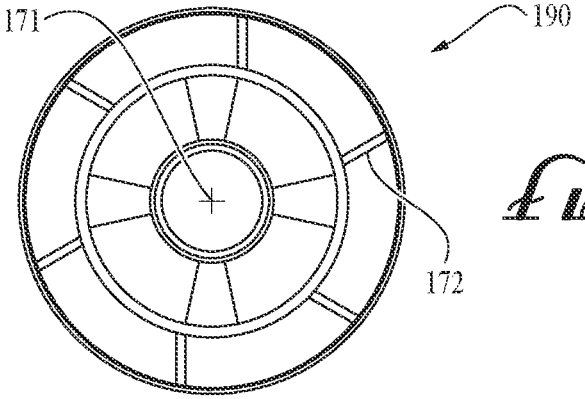
FIG. 4B is an illustration of a diffuser of a centrifugal pump stage looking uphole into an inlet of the diffuser according to an embodiment of the disclosure.
Figure 4C:
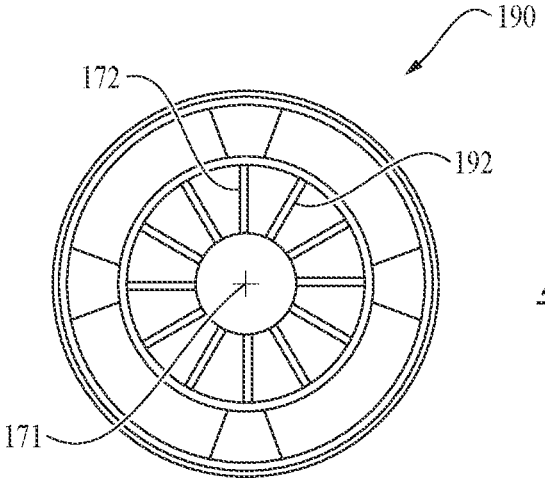
FIG. 4C is an illustration of a diffuser of a centrifugal pump stage looking downhole into an outlet of the diffuser according to an embodiment of the disclosure.

Turning now to FIG. 4A, FIG. 4B, and FIG. 4C, a diffuser 190 suitable for use in combination with the impeller 152 to form the centrifugal pump stage 150 is described. The diffuser 190 defines an inlet 166 at a downhole open end and an outlet 180 at an uphole open end. The diffuser 190 differs from the diffuser 170 described above with reference to FIG. 3A, FIG. 3B, and FIG. 3C in having a plurality of truncated vanes 192 each disposed between two of the vanes 172 and each extending radially outward from the hub structure 173 to the shroud structure 174. A leading edge 191 of the truncated vanes 192 is disposed uphole of the leading edge 175 of the vanes 172. A trailing edge 193 of the truncated vanes 192 is disposed at about the same axial position as the trailing edge 176 of the vanes 170. In an embodiment, the truncated vanes 192 are each spaced about an equal angular distance apart between the vanes 170, rotated around the centerline axis 171. In another embodiment, the truncated vanes 192 are not equally spaced angularly rotated around the centerline axis 171. In an embodiment, the truncated vanes 192 are located between one fifth and two fifths of the angular distance between two truncated vanes 192 from a first one of the two vanes 170. For example, a truncated vane 192 may be located about one fifth of the angular distance between two surrounding vanes 170 away from a first one of the two surrounding vanes 170 and located about four fifths of the angular distance away fro the second one of the two surrounding vanes 170. For example, a truncated vane 192 may be located about one third of the angular distance between two surrounding vanes 170 away from a first one of the two surrounding vanes 170 and located about two third of the angular distance away from the second one of the two surrounding vanes 170. The truncated vanes 192 are each of one-piece construction.

The diffuser 190 defines a plurality of flow passages bounded radially by the outward facing side of the hub structure 173, by the inward facing side of the shroud structure 174, and by two of the vanes 172, 192. Downhole of the truncated vanes 192, flow passages are defined between the vanes 172, the hub structure 173, and the shroud structure 174. Beginning at the leading edge 191 of the truncated vanes 192, each of these flow passages defined between two vanes 172 are split into two downstream flow passages.

In an embodiment, the truncated vanes 192 define a concave shape on one side and a convex shape on the opposite side when viewed from their outside edges looking radially inward towards the hub structure 173. In an embodiment, the truncated vane 192 proximate the leading edge 191 makes an angle relative to the centerline 171 that lessens as the truncated vane 192 proceeds from the leading edge 191 to the trailing edge 193 such that the truncated vane 192 proximate the trailing edge 193 is substantially parallel to the centerline 171. While in FIG. 4A, the vanes 172, 192 are illustrated as slanted from right to left from downhole to uphole, in another embodiment, the vanes 172, 192 may slant in the opposite sense, from left to right from downhole to uphole. As best seen in FIG. 4A, in an embodiment, an outside edge of the leading edge 191 where it attaches to the inside of the shroud structure 174 is further downhole than an inside edge of the leading edge 191 where it attaches to the outside of the hub structure 173. In an embodiment, an outside edge of the trailing edge 193 is further uphole than an inside edge of the trailing edge 193 where it attaches to the outside of the hub structure 173.

In an embodiment, the truncated vane 192 has an axial length between one quarter (¼) of and three quarters (¾) of the axial length of the vane 172. As used herein, the term 'axial length' of a vane means the distance, considered on a convex surface of the vane, between a point on the leading edge of the vane midway between the hub structure 173 and the shroud structure 174 and a point on the trailing edge of the vane midway between the hub structure 173 and the shroud structure 174. In an embodiment, the diffuser 190 is formed of metal material. The diffuser 190 may be manufactured by casting and finishing. The diffuser 190 may be manufactured by a 3-D printing process.

In an embodiment, the truncated vane 192 has an axial length of about eight tenths (8/10 or 4/5) of the axial length of the vane 172. In an embodiment, the truncated vane 192 has an axial length of about seven tenths (7/10) of the axial length of the vane 172. In an embodiment, the truncated vane 192 has an axial length of about six tenths (6/10 or 3/5) of the axial length of the vane 172, In an embodiment, the truncated vane 192 has an axial length of about five tenths (5/10 or ½) of the axial length of the vane 172. In an embodiment, the truncated vane 192 has an axial length of about four tenths (4/10 or 2/5) of the axial length of the vane 172. In an embodiment, the truncated vane 192 has an axial length of about three tenths (3/10) of the axial length of the vane 172. In an embodiment, the truncated vane 192 has an axial length of about two tenths (2/10 or 1/5) of the axial length of the vane 172. In an embodiment, the truncated vane 192 has an axial length of about 2/3 of the axial length of the vane 172. Analysis of the diffuser 190 and vanes 172, 192 using a CFD tool can used to determine a specific preferred axial length of the truncated vane 192 for various desired fluid flow regimes of the centrifugal pump 116. FIG. 4B shows a view looking uphole into the inlet 166 of the diffuser 190. FIG. 4C shows a view looking downhole into the outlet 180 of the diffuser 190.

The vanes 172 of the diffuser 190 are substantially similar to the vanes 172 of FIG. 3A, FIG. 3B, FIG. 3C, and FIG. 3D. It is a teaching of the present disclosure that by placing truncated vanes 192 between the vanes 172 of the diffuser 190, the tendency of fluid flow separation to occur in region 177 on the low-pressure side of the vane 172 and/or the tendency of fluid flow separation to occur in region 178 on the high-pressure side of the vane 172 is reduced, allowing the efficient operating range of the centrifugal pump 116 to be expanded. In an embodiment, the diffuser 190 comprises six vanes 172 and six truncated vanes 192. In another embodiment, the diffuser 190 comprises four vanes 172 and four truncated vanes 192. In another embodiment, the diffuser 190 comprises five vanes 172 and five truncated vanes 192. In another embodiment, the diffuser 190 comprises seven vanes 172 and seven truncated vanes 192. In another embodiment, the diffuser 190 comprises eight vanes 172 and eight truncated vanes 192. In general, the diffuser 190 may comprise any number of vanes 172 and an equal number of truncated vanes 192.

Figure 5A:
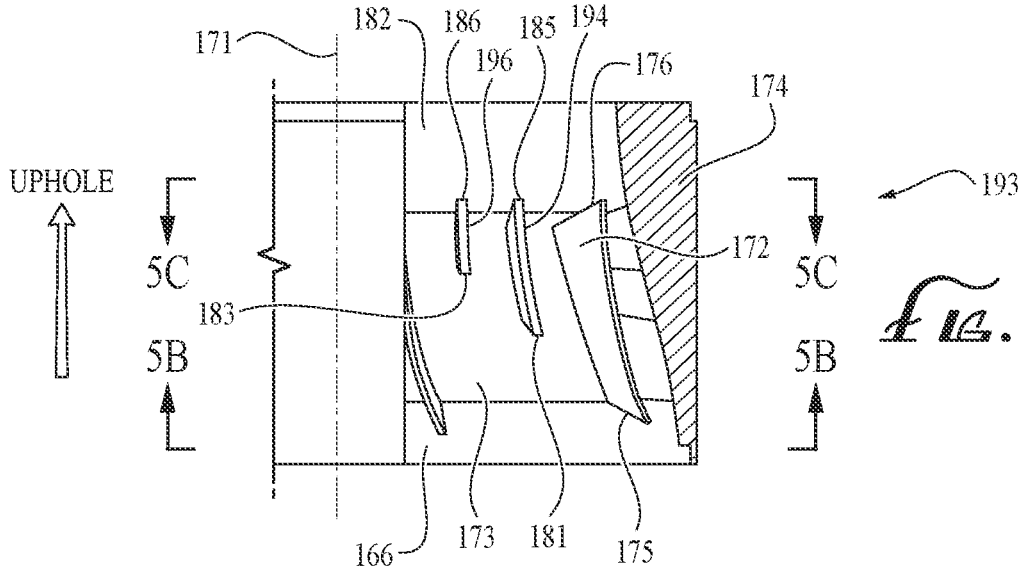
FIG. 5A is an illustration of a diffuser of a centrifugal pump stage according to another embodiment of the disclosure.
Figure 5B:
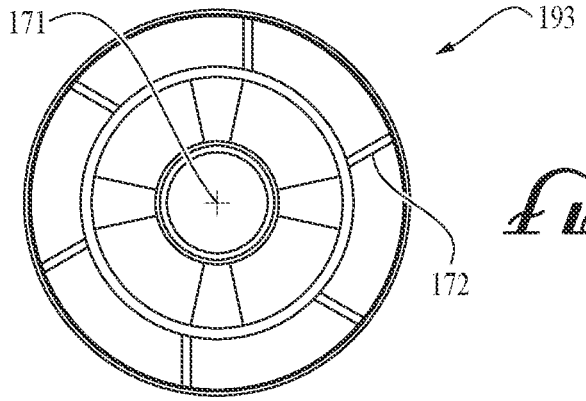
FIG. 5B is an illustration of a diffuser of a centrifugal pump stage looking uphole into an inlet of the diffuser according to another embodiment of the disclosure.
Figure 5C:
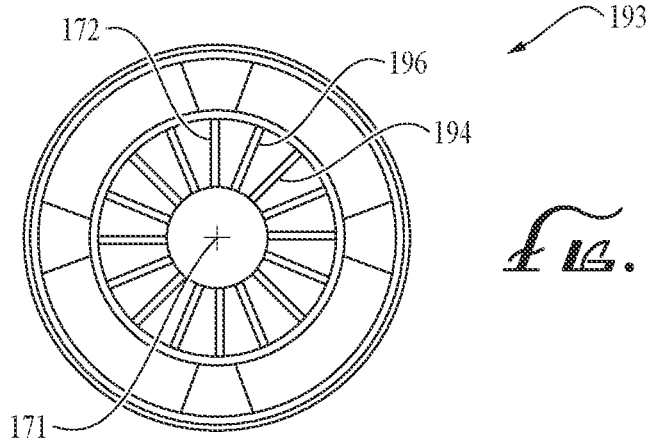
FIG. 5C is an illustration of a diffuser of a centrifugal pump stage looking downhole into an outlet of the diffuser according to another embodiment of the disclosure.

Turning now to FIG. 5A, FIG. 5B, and FIG. 5C, a diffuser 193 suitable for use in combination with the impeller 152 to form the centrifugal pump stage 150 is described. The diffuser 193 defines an inlet 166 at a downhole open end and an outlet 182 at an uphole open end. The diffuser 193 differs from the diffuser 190 described above with reference to FIG. 4A, FIG. 4B, and FIG. 4C in having two different truncated vanes 194, 196 disposed between every two of the vanes 172. The different truncated vanes 194, 196 differ from each other in axial length. FIG. 5B shows a view looking uphole into the inlet 166 of the diffuser 193. FIG. 5C shows a view looking downhole into the outlet 182 of the diffuser 193. The axial length of the truncated vane 196 is less than the axial length of the truncated vane 194, and the axial length of the truncated vane 194 is less than the axial length of the vane 172. In an embodiment, the vanes 172, 194, and 196 are each spaced about an equal angular distance apart, rotated around the centerline axis 171. In another embodiment, the vanes 172 are spaced about an equal angular distance apart from each other, but the truncated vanes 194, 196 are not spaced an equal angular distance apart from the vane 172 and/or from each other. The truncated vanes 194 are each of one-piece construction, and the truncated vanes 196 are each of one-piece construction.

The diffuser 193 defines a plurality of flow passages bounded radially by the outward facing side of the hub structure 173, by the inward facing side of the shroud structure 174, and by two of the vanes 172, 192. Downhole of the truncated vanes 192, flow passages are defined between the vanes 172, the hub structure 173, and the shroud structure 174. Beginning at the leading edge 191 of the truncated vanes 192, each of these flow passages defined between two vanes 172 are split into two downstream flow passages.

In an embodiment, the truncated vanes 194, 196 define a concave shape on one side and a convex shape on the opposite side when viewed from their outside edges looking radially inward towards the hub structure 173. In an embodiment, the truncated vane 194 proximate the leading edge 181 makes an angle relative to the centerline 171 that lessens as the truncated vane 194 proceeds from the leading edge 181 to the trailing edge 185 such that the truncated vane 194 proximate the trailing edge 185 is substantially parallel to the centerline 171. In an embodiment, the truncated vane 196 proximate the leading edge 183 makes an angle relative to the centerline 171 that lessens as the truncated vane 196 proceeds from the leading edge 183 to the trailing edge 186 such that the truncated vane 196 proximate the trailing edge 186 is substantially parallel to the centerline 171. While in FIG. 5A, the vanes 172, 194, 196 are illustrated as slanted from right to left from downhole to uphole, in another embodiment, the vanes 172, 194, 196 may slant in the opposite sense, from left to right from downhole to uphole. As best seen in FIG. 5A, in an embodiment, an outside edge of the leading edge 181 of truncated vane 194 where it attaches to the inside of the shroud structure 174 is further downhole than an inside edge of the leading edge 181 of truncated vane 194 where it attaches to the outside of the hub structure 173. In an embodiment, an outside edge of the trailing edge 185 of the truncated vane 194 is further uphole than an inside edge of the trailing edge 185 of the truncated vane 194 where it attaches to the outside of the hub structure 173. As best seen in FIG. 5A, in an embodiment, an outside edge of the leading edge 183 of truncated vane 196 where it attaches to the inside of the shroud structure 174 is further downhole than an inside edge of the leading edge 183 of truncated vane 196 where it attaches to the outside of the hub structure 173. In an embodiment, an outside edge of the trailing edge 186 of the truncated vane 196 is further uphole than an inside edge of the trailing edge 186 of the truncated vane 196 where t attaches to the outside of the hub structure 173.

In an embodiment, the axial length of the truncated vane 196 is about one half (½) of the axial length of the truncated vane 194. In an embodiment, the axial length of the truncated vane 196 is about two thirds (⅔) of the axial length of the truncated vane 194. In an embodiment, the vanes 172, 194, 196 are spaced about equal angular distances from each other between the hub structure 173 and the shroud structure 174.

In an embodiment, the truncated vane 194 has an axial length of about eight tenths (8/10 or 4/5) of the axial length of the vane 172 and the truncated vane 196 has an axial length of about four tenths (4/10 or 2/5) of the axial length of the vane 172. In an embodiment, the truncated vane 194 has an axial length of about seven tenths (7/10) of the axial length of the vane 172 and the truncated vane 196 has an axial length of about seven twentieths (7/20) of the axial length of the vane 172. In an embodiment, the truncated vane 194 has an axial length of about six tenths (6/10 or 3/5) of the axial length of the vane 172 and the truncated vane 196 has an axial length of about four tenths (3/10) of the axial length of the vane 172. In an embodiment, the truncated vane 194 has an axial length of about five tenths (5/10 or ½) of the axial length of the vane 172 and the truncated vane 196 has an axial length of about five twentieths (5/20 or ¼) of the axial length of the vane 172. In an embodiment, the truncated vane 194 has an axial length of about four tenths (4/10 or 2/5) of the axial length of the vane 172 and the truncated vane 196 has an axial length of about two tenths (2/10 or 1/5) of the axial length of the vane 172. In an embodiment, the truncated vane 194 has an axial length of about three tenths (3/10) the axial length of the vane 172 and the truncated vane 196 has an axial length of about three twentieths (3/20) of the axial length of the vane 172. In an embodiment, the truncated vane 194 has an axial length of about two tenths (2/10 or 1/5) of the axial length of the vane 172 and the truncated vane 196 has an axial length of about one tenth (1/10) of the axial length of the vane 172. In an embodiment, the truncated vane 194 has an axial length of about ⅔ of the axial length of the vane 172 and the truncated vane 196 has an axial length of about one third of the axial length of the vane 172. Analysis of the diffuser 193 and vanes 172, 194, 196 using a CFD tool can used to determine a specific preferred axial length of the truncated vanes 194, 196 for various desired fluid flow regimes of the centrifugal pump 116.

The vanes 172 of the diffuser 193 are substantially similar to the vanes 172 of FIG. 3A, FIG. 3B, FIG. 3C, and FIG. 3D. It is a teaching of the present disclosure that by placing truncated vanes 194, 196 between the vanes 172 of the diffuser 193, the tendency of fluid flow separation to occur in region 177 on the low-pressure side of the vane 172 and/or the tendency of fluid flow separation to occur in region 178 on the high-pressure side of the vane 172 is reduced, allowing the efficient operating range of the centrifugal pump 116 to be expanded. It is thought that by placing the truncated vane 196 between the truncated vane 194 and a vane 172, the tendency for fluid flow separation to occur at the uphole high-pressure side and/or fluid flow separation to occur at the uphole low-pressure side of the truncated vane 194 is reduced, allowing the efficient operating range of the centrifugal pump 116 to be extended. It is possible that a centrifugal pump 116 comprising pump stages 150 using the diffusers 193 may have an expanded efficient operating range relative to the efficient operating range of a centrifugal pump 116 comprising pump stages 150 using the diffusers 190.

In an embodiment, the diffuser 193 comprises six vanes 172, six truncated vanes 194, and six truncated vanes 196. In another embodiment, the diffuser 190 comprises four vanes 172, four truncated vanes 194, and four truncated vanes 196. In another embodiment, the diffuser 193 comprises five vanes 172, five truncated vanes 194, and five truncated vanes 196. In another embodiment, the diffuser 193 comprises seven vanes 172, seven truncated vanes 194, and seven truncated vanes 196. In another embodiment, the diffuser 193 comprises eight vanes 172, eight truncated vanes 194, and eight truncated vanes 196. In general, the diffuser 193 may comprise any number of vanes 172, an equal number of truncated vanes 194, and an equal number of truncated vanes 196. In an embodiment, the diffuser 193 is formed of metal material. The diffuser 193 may be manufactured by casting and finishing. The diffuser 193 may be manufactured by a 3-D printing process.

Figure 6:
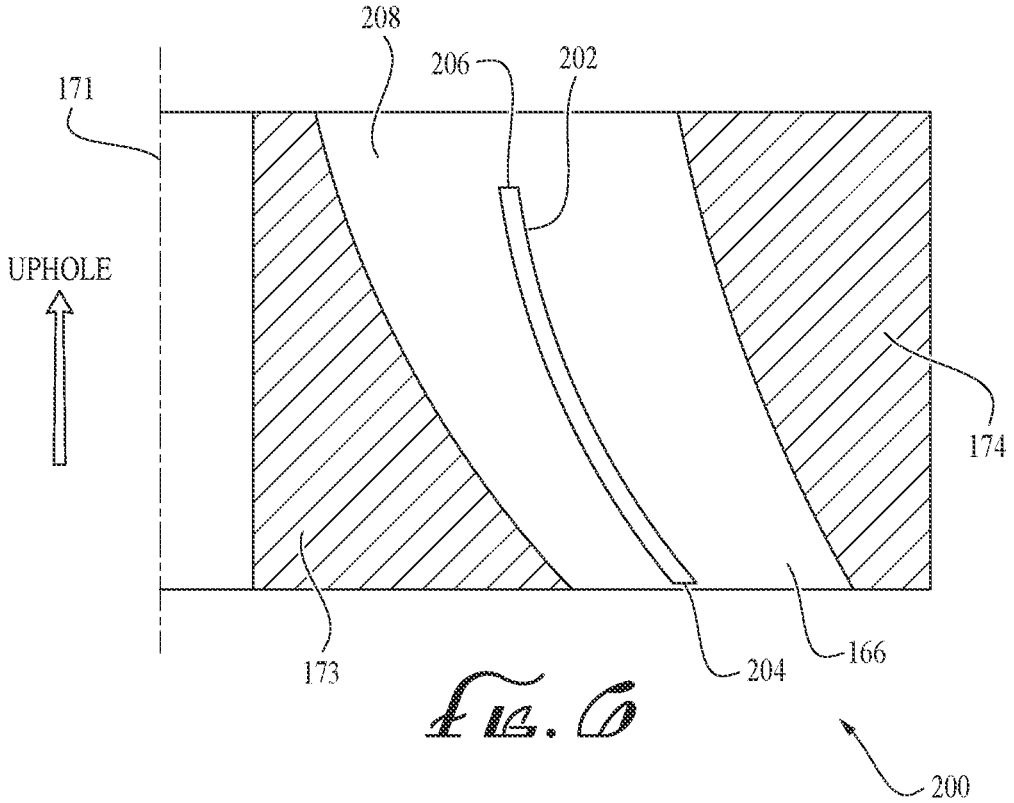
FIG. 6 is an illustration of a cross-section of a diffuser of a centrifugal pump stage according to yet another embodiment of the disclosure.

Turning now to FIG. 6, a cross-section of a diffuser 200 is described. In an embodiment, the diffuser 200 may comprise vanes 172 as described with reference to FIG. 3A, FIG. 38, and FIG. 30 without truncated vanes 192, 194, 196 described with reference to FIG. 4A, FIG. 4B, FIG. 4C, FIG. 5A, FIG. 5B, and FIG. 5C. In an embodiment, the diffuser 200 may comprise vanes 172 and truncated vanes 192 as described with reference to FIG. 4A, FIG. 4B, and FIG. 4C. In an embodiment, the diffuser 200 may comprise vanes 172 and truncated vanes 194, 196 as described with reference to FIG. 5A, FIG. 5B, and FIG. 5C. In FIG. 6 the vanes 172, 192, 194, 196 are omitted from the illustration to make the view more understandable.

The view of the diffuser 200 is a cross-section view showing the hub structure 173, the shroud structure 174, and an axial vane 202 defining a leading edge 204 and a trailing edge 206. The diffuser 200 defines an inlet 166 at a downhole open end and an outlet 208 at an uphole open end. It will be appreciated that the view of FIG. 6 can be rotated around the centerline 171 to define three solids of revolution—a first solid of revolution comprising the hub structure 173, a second solid of revolution comprising the shroud structure 174, and a third solid of revolution comprising the axial vane 202. The axial vane 202 constituted by the third solid or revolution may also be referred to in some contexts as a ring vane. The third solid of revolution—the axial vane 202—may be retained in its position by any of the vanes 172, 192, 194, 196. The diffuser 200 defines flow passages between vanes 172, 192, 194, and/or 196 and between the outward facing surface of the hub structure 173 and an inward facing surface of the axial vane 206 and other flow passages between vanes 172, 192, 194 and/or 196 between the inward facing surface of the shroud structure 174 and the outward facing surface of the axial vane 206. In an embodiment, the axial vane 202 is spaced about an equal distance from the hub structure 173 and from the shroud structure 174. In an embodiment, the axial vane 202 is spaced closer to the hub structure 173 than to the shroud structure 174 or is spaced closer to the shroud structure 173 than to the hub structure 174. In an embodiment, the axial vane 202 is spaced about an equal radial distance between the hub structure 173 and the shroud structure 174. In an embodiment, the axial vane 202 is spaced away from the hub structure 173 a distance of between one fifth and two fifths of the radial distance between the hub structure 173 and the shroud structure 174. In an embodiment, the axial vane 202 is spaced away from the hub structure 173 a distance of between three fifths and four fifths of the radial distance between the hub structure 173 and the shroud structure 174.

The axial vane 202 may extend from about the downhole end of the diffuser 200, proximate the inlet 166, to just inside the outlet 208. The axial vane 202 may extend from about the downhole end of the vane 172 (not shown in FIG. 6) to about the uphole end of the vane 172. It is a teaching of the present disclosure that by placing the axial vane 202 as illustrated between the hub structure 173 and the shroud structure 174, the tendency of fluid flow separation to occur in the region 179 on the uphole end of the surface of the hub structure 173 facing away from the centerline 171 as illustrated in FIG. 3E and the tendency of fluid flow separation to occur in the region 180 on the uphole end of the surface of the shroud structure 174 facing towards the centerline 171 as illustrated in FIG. 3E is reduced, allowing the efficient operating range of the centrifugal pump 116 to be expanded. In an embodiment, the diffuser 200 is formed of metal material. The diffuser 200 may be manufactured by casting and finishing. The diffuser 200 may be manufactured by a 3-D printing process.

Figure 7:
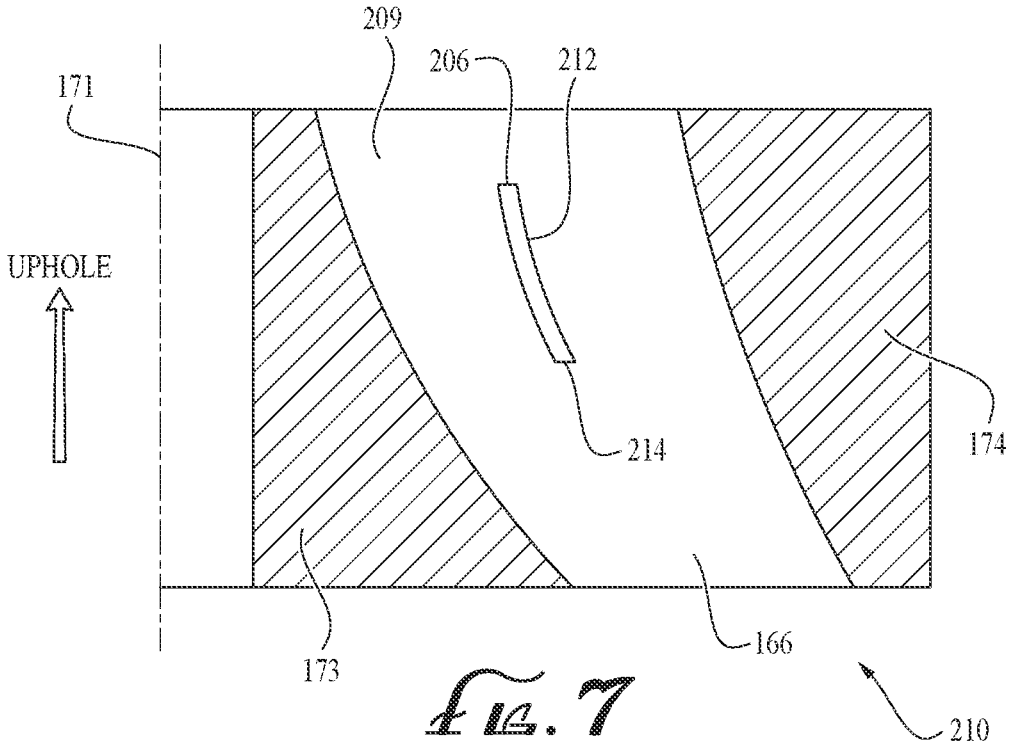
FIG. 7 is an illustration of a cross-section of a diffuser of a centrifugal pump stage according to yet another embodiment of the disclosure.

Turning now to FIG. 7, a cross-section of a diffuser 210 is described. In an embodiment, the diffuser 200 may comprise vanes 172 as described with reference to FIG. 3A, FIG. 3B, and FIG. 3C without truncated vanes 192, 194, 196 described with reference to FIG. 4A, FIG. 4B, FIG. 4C, FIG. 5A, FIG. 5B, and FIG. 5C. In an embodiment, the diffuser 210 may comprise vanes 172 and truncated vanes 192 as described with reference to FIG. 4A, FIG. 4B, and FIG. 4C. In an embodiment, the diffuser 210 may comprise vanes 172 and truncated vanes 194, 196 as described with reference to FIG. 5A, FIG. 5B, and FIG. 5C. In FIG. 7 the vanes 172, 192, 194, 196 are omitted from the illustration to make the view more understandable.

The view of the diffuser 210 is a cross-section view showing the hub structure 173, the shroud structure 174, and an axial vane 212 defining a leading edge 214 and a trailing edge 216. The diffuser 210 defines an inlet 166 at a downhole open end and an outlet 209 at an open uphole end. It will be appreciated that the view of FIG. 7 can be rotated around the centerline 171 to define three solids of revolution—a first solid of revolution comprising the hub structure 173, a second solid of revolution comprising the shroud structure 174, and a third solid of revolution comprising the axial vane 212. The third solid of revolution—the axial vane 212—may be retained in its position by any one or more of the vanes 172, 192, 194, and/or 196, Downhole of the leading edge 214 of the axial vane 212, the diffuser 210 defines flow passages between the outward facing surface of the hub structure 173, the inward facing surface of the shroud structure 174, and the vanes 172, 192, 194, and/or 196. Uphole of the leading edge 214 of the axial vane 212, the diffuser 210 defines flow passages between vanes 172, 192, 194, and/or 196 and between the outward facing surface of the hub structure 173 and an inward facing surface of the axial vane 212 and other flow passages between vanes 172, 192, 194, and/or 196 between the inward facing surface of the shroud structure 174 and the outward facing surface of the axial vane 212.

The axial vane 212 may extend from about the middle of the diffuser 210, to just inside the outlet 209. The diffuser 210 is substantially similar to the diffuser 200 with the difference that the axial vane 212 may be considered a shortened or truncated version of the axial vane 202 of diffuser 200. In an embodiment, the axial length of the axial vane 212 is between three quarters (¾) of the axial length of the vane 172 and one quarter (¼) of the axial length of the vane 172. In an embodiment the axial length of the axial vane 212 is about three fourths (¾) of the axial length of the vane 172. In an embodiment, the axial length of the axial vane 212 is about two thirds (⅔) of the axial length of the vane 172. In an embodiment, the axial length of the axial vane 212 is about one half (½) of the axial length of the vane 172. In an embodiment, the axial length of the axial vane 212 is about one third (⅓) of the axial length of the vane 172.

In an embodiment, the axial vane 212 is spaced about an equal distance from the hub structure 173 and from the shroud structure 174. In an embodiment, the axial vane 212 is spaced closer to the hub structure 173 than to the shroud structure 174 or is spaced closer to the shroud structure 173 than to the hub structure 174. In an embodiment, the axial vane 212 is spaced about an equal radial distance between the hub structure 173 and the shroud structure 174. In an embodiment, the axial vane 212 is spaced away from the hub structure 173 a distance of between one fifth and two fifths of the radial distance between the hub structure 173 and the shroud structure 174. In an embodiment, the axial vane 212 is spaced away from the hub structure 173 a distance of between three fifths and four fifths of the radial distance between the hub structure 173 and the shroud structure 174.

Analysis of the diffuser 210, axial vane 212, and vanes 172, 192, 194, and/or 196 using a CFD tool can used to determine a specific preferred axial length of the axial vane 212 for various desired fluid flow regimes of the centrifugal pump 116. It is a teaching of the present disclosure that by placing the axial vane 212 as illustrated between the hub structure 173 and the shroud structure 174, the tendency of fluid flow separation to occur in the region 179 on the uphole end of the surface of the hub structure 173 facing away from the centerline 171 as illustrated in FIG. 3E and the tendency of fluid flow separation to occur in the region 180 on the uphole end of the surface of the shroud structure 174 facing towards the centerline 171 as illustrated in FIG. 3E is reduced, allowing the efficient operating range of the centrifugal pump 116 to be expanded.

In an embodiment, a plurality of axial vanes are placed between the hub structure 173 and the shroud structure 174. The axial vanes may be spaced approximately equally offset from the hub structure 173, each other, and the shroud structure 174. For example, a first one of two axial vanes may located about one third the radial distance from the hub structure 173 to the shroud structure 174, while a second one of two axial vanes may be located about two thirds of the radial distance from the hub structure 173 to the shroud structure 174. In an embodiment, the diffuser 210 is formed of metal material. The diffuser 210 may be manufactured by casting and finishing. The diffuser 210 may be manufactured by a 3-D printing process.

Figure 8:
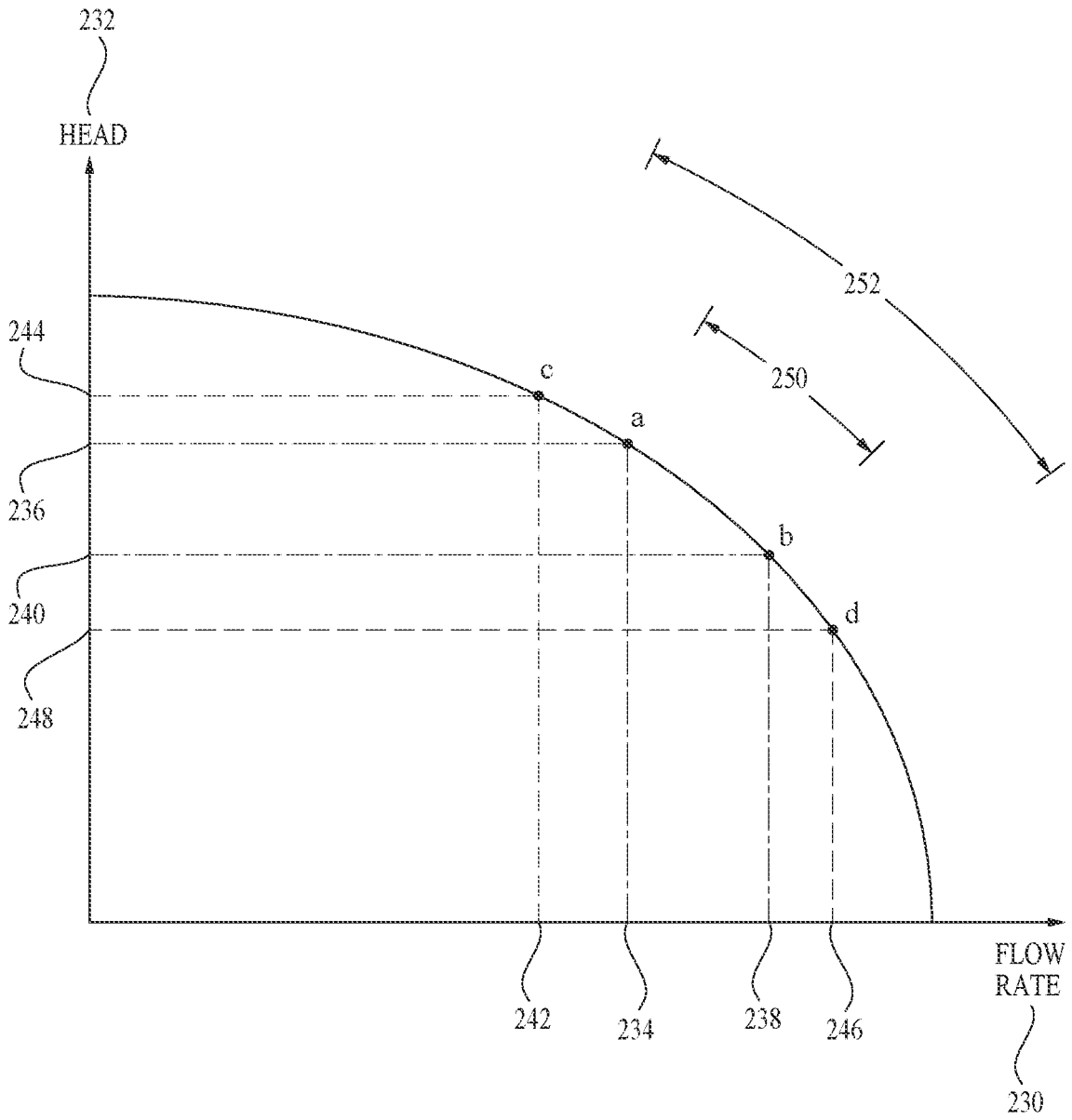
FIG. 8 is a graph of pump performance curve according to an embodiment of the disclosure.

Turning now to FIG. 8, an exemplary centrifugal pump head versus fluid flow rate graph is described. The graph of FIG. 8 does not provide any units of flow rate or units of head, because the curve is meant to be approximately representative of the performance curve of any centrifugal pump pumping any given fluid. A centrifugal pump may be expected to have an efficient operating range 250 on the curve from a point "a" to a point "b." Point "a" on the pump curve has a flow rate identified by label 234 and a head identified by label 236. Point "b" on the pump curve has a flow rate identified by label 238 and a head identified by label 240. It is expected that if the centrifugal pump is operated at a higher flow rate than identified by label 238, the pump will operate inefficiently. It is expected that if the centrifugal pump is operated at a higher head than identified by label 236, the pump will operate inefficiently.

It is a teaching of the present disclosure that by incorporating the truncated vanes 192 along with the vane 172 as described with reference to FIG. 4A, FIG. 4B, and FIG. 4B in the diffusers of the given centrifugal pump 116 or by incorporating the truncated vanes 194, 196 along with the vane 172 as described with reference to FIG. 5A, FIG. 6B, and FIG. 5C in the diffusers of the given centrifugal pump 116, the centrifugal pump 116 may be modified to have a broader efficient operating range 252 on the curve from point "c" to point "d." Point "c" on the pump curve has a flow rate identified by label 242 and a head identified by label 244. Point "d" on the pump curve has a flow rate identified by label 246 and a head identified by label 248. At point "c" the flow rate is less than the flow rate at point "a" and the head is greater than the head at point "a." At point "d" the flow rate is greater than the flow rate at point "b" and the head is less than the head at point "b." Not wishing be bound by theory, it is thought that the broader efficient operating range when employing some combination of truncated vanes 192, 194, 196 with the vane 172 is due to attenuating the propensity for fluid flow separation to occur in the regions 177, 178 near the uphole end of the vane 172 near the limits of the efficient operating range, thereby extending those limits as described above. It is also a teaching of the present disclosure that in a similar way incorporating the axial vane 202 or the axial vane 212 into a diffuser having the vane 172 can likewise extend the limits of the efficient operating range of the centrifugal pump 116. It is also a teaching of the present disclosure that incorporating the axial vane 202 or the axial vane 212 into a diffuser having the vane 172 and having some combination of truncated vanes 192, 194, 196 can extend the limits of the efficient operating range of the centrifugal pump 116. The teachings of the present disclosure may provide a centrifugal pump 116 that provides higher head, higher flow rate, higher efficiency, and/or an extended service life.

Figure 9:
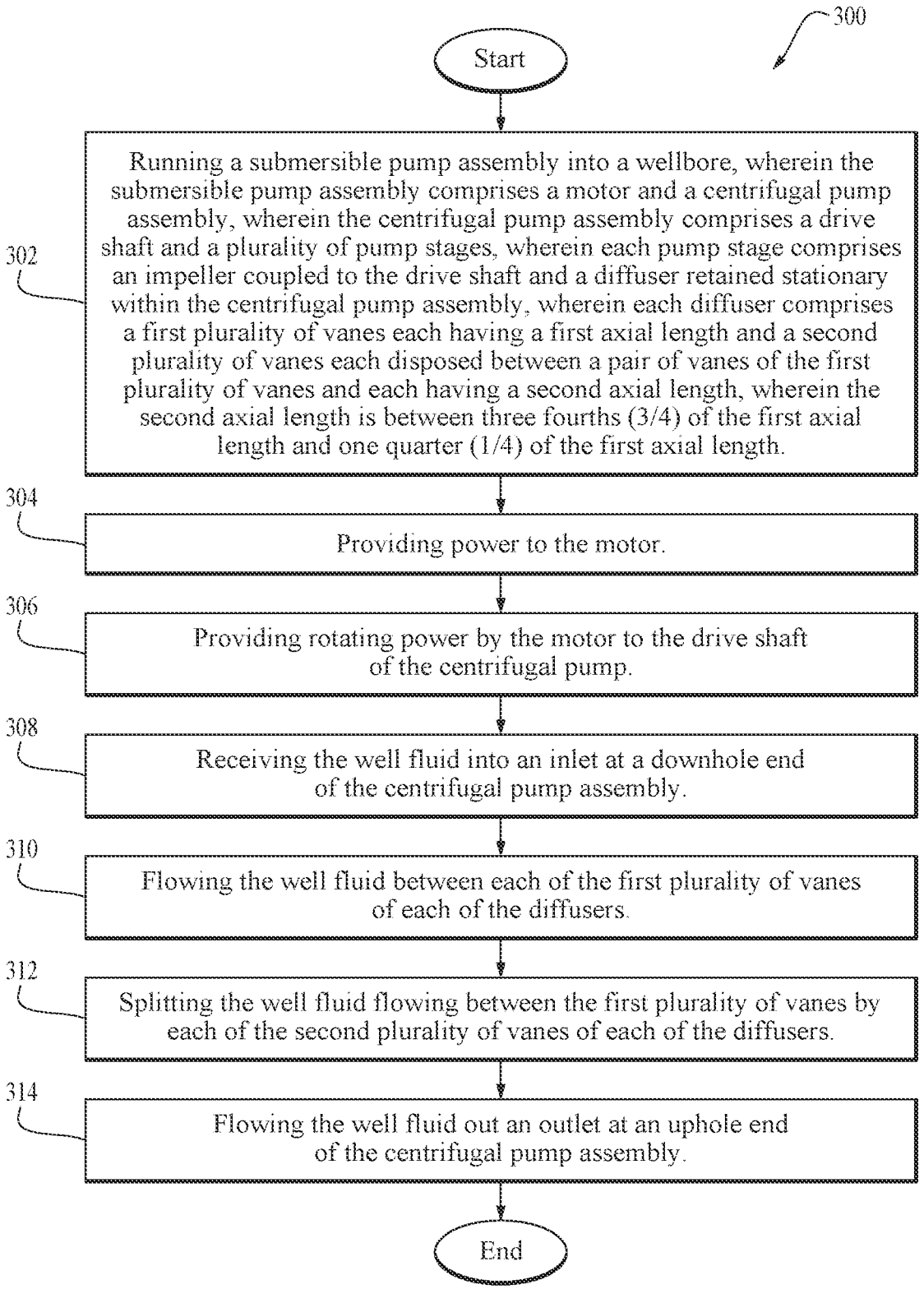
FIG. 9 is a flow chart of a method according to an embodiment of the disclosure.

Turning now to FIG. 9, a method 300 is described. In an embodiment, the method 300 is a method of lifting well fluid to a surface. At block 302, the method 300 comprises running a submersible pump assembly into a wellbore, wherein the ESP assembly comprises a motor and a centrifugal pump assembly, wherein the centrifugal pump assembly comprises a drive shaft and a plurality of pump stages, wherein each pump stage comprises an impeller coupled to the drive shaft and a diffuser retained stationary within the centrifugal pump assembly, wherein each diffuser comprises a first plurality of vanes each having a first axial length and a second plurality of vanes each disposed between a pair of vanes of the first plurality of vanes and each having a second axial length, wherein the second axial length is between three quarters (¾) of the first axial length and one quarter (¼) of the first axial length. In an embodiment the motor is an electric motor, and the submersible pump assembly is an electric submersible pump (ESP) assembly. In another embodiment, the motor is a hydraulic turbine or a hydraulic motor. In yet another embodiment, the motor is a pneumatic turbine or an air motor.

At block 304, the method 300 comprises providing power to the motor. Power to an electric motor may be provided from a surface location via an electric power cable to the electric motor, Power to a hydraulic turbine or hydraulic motor may be provided from a surface location via a tube to the hydraulic turbine or hydraulic motor. Power to a pneumatic turbine or air motor may be provided from a surface location via a tube to the pneumatic turbine or air motor. At block 306, the method 300 comprises providing rotating power by the motor to the drive shaft of the centrifugal pump. At block 308, the method 300 comprises receiving the well fluid into an inlet at a downhole end of the centrifugal pump assembly.

At block 310, the method 300 comprises flowing the well fluid between each of the first plurality of vanes of each of the diffusers. At block 312, the method 300 comprises splitting the well fluid flowing between the first plurality of vanes by each of the second plurality of vanes of each of the diffusers. In an embodiment, splitting the well fluid flowing between the first plurality of vanes by each of the second plurality of vanes prevents or reduces separation of the fluid proximate the surfaces of the first plurality of vanes. At block 314, the method 300 comprises flowing the well fluid out an outlet at an uphole end of the centrifugal pump assembly.

In an embodiment of the method 300, each diffuser comprises a third plurality of vanes each having a third axial length, wherein the third axial length is less than the second axial length and wherein each of the third plurality of vanes is disposed between one of the vanes of the first plurality of vanes and one of the vanes of the second plurality of vanes, further comprising splitting the well fluid flowing between the first plurality of vanes and the second plurality of vanes by each of the third plurality of vanes. In an embodiment of the method 300, each diffuser comprises a ring vane disposed between an outside of a hub structure of the diffuser and an inside of a shroud structure of the diffuser, further comprising splitting the well fluid flowing between the outside of the hub structure of the diffuser and the inside of the shroud structure by the by the ring vane. In an embodiment of the method 300, a trailing edge of each of the second plurality of vanes is located at about a same uphole location as a trailing edge of each of the first plurality of vanes and wherein a leading edge of each of the second plurality of vanes is located uphole of a leading edge of each of the first plurality of vanes. In an embodiment of the method 300, the second axial length is about two thirds (⅔) of the first axial length. In embodiment of method 300, splitting the well fluid flowing between the first plurality of vanes by each of the second plurality of vanes of each of the diffusers prevents separation of the well fluid proximate the surfaces of the first plurality of vanes.

Figure 10:
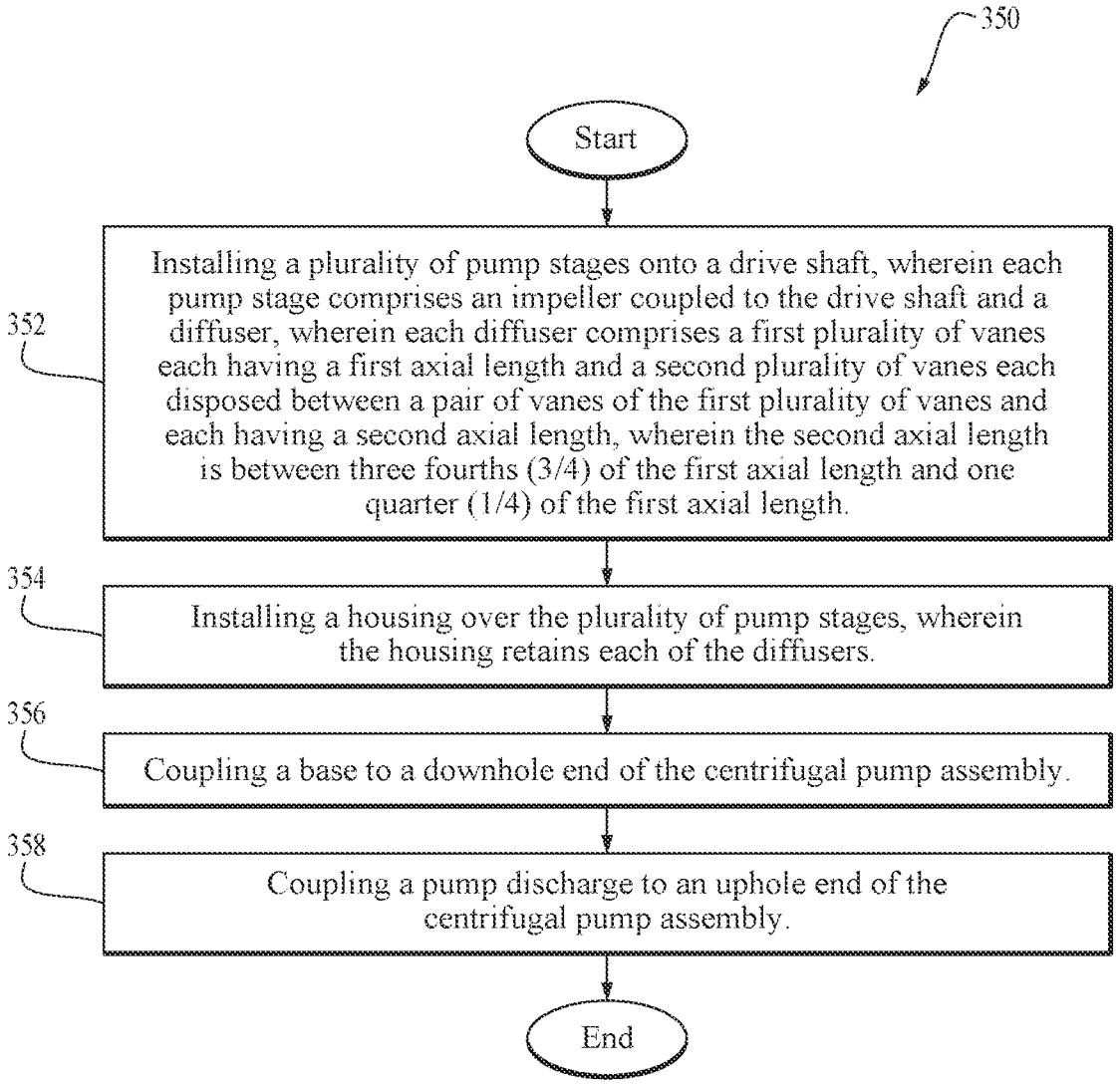
FIG. 10 is a flow chart of another method according to an embodiment of the disclosure.

Turning now to FIG. 10, a method 350 is described. In an embodiment, the method 350 is a method of assembling a centrifugal pump assembly. At block 352, the method 350 comprises installing a plurality of pump stages onto a drive shaft, wherein each pump stage comprises an impeller coupled to the drive shaft and a diffuser, wherein each diffuser comprises a first plurality of vanes each having a first axial length and a second plurality of vanes each disposed between a pair of vanes of the first plurality of vanes and each having a second axial length, wherein the second axial length is between three quarters (¾) of the first axial length and one quarter (¼) of the first axial length.

At block 354, the method 350 comprises installing a housing over the plurality of pump stages, wherein the housing retains each of the diffusers. At block 356, the method 350 comprises coupling a base to a downhole end of the centrifugal pump assembly. At block 358, the method 350 comprises coupling a pump discharge to an uphole end of the centrifugal pump assembly.

In an embodiment of the method 350, each of the diffusers has a ring vane that is approximately concentric with a centerline of the diffuser. In an embodiment of the method 350, each of the diffusers comprises a third plurality of vanes each disposed between one of the vanes of the first plurality of vanes and one of the vanes of the second plurality of vanes, wherein an axial length of each of the third plurality of vanes is less than the second axial length and wherein each of the diffusers has a ring vane that is approximately concentric with a centerline of the diffuser. In an embodiment of method 350, for each of the diffusers, the trailing edges of each of the second plurality of vanes is located at about a same uphole location as the trailing edges of each of the first plurality of vanes and wherein the leading edges of each of the second plurality of vanes is located uphole of the leading edges of each of the first plurality of vanes. IN an embodiment of method 350, for each of the diffusers, a first side of each of the first plurality of vanes is concave and an opposite side of each of the first plurality of vanes is convex.

Figure 11:
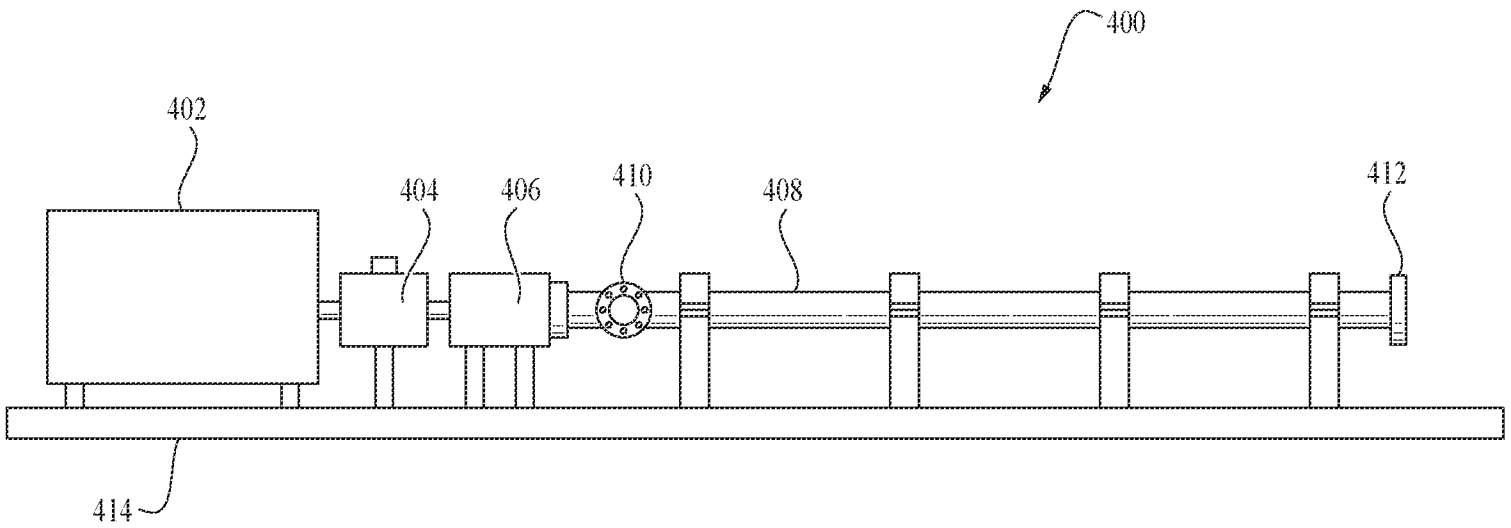
FIG. 11 is an illustration of a horizontal pumping system (HPS) according to an embodiment of the disclosure.

Turning now to FIG. 11, a horizontal pumping system (HPS) 400 is described. In an embodiment, the HSP 400 comprises a motor 402, a rotational coupling 404, a mechanical seal 406, and a centrifugal pump assembly 408. In an embodiment, a fluid inlet 410 is integrated into a first end of the centrifugal pump assembly 408 and a fluid outlet 412 may be integrated into a second end of the centrifugal pump assembly 408. The motor 402, the rotational coupling 404, the mechanical seal 406, and the centrifugal pump assembly 408 may be mounted on a skid 414 such that it can be easily transported to a location on a truck and placed on the ground at the location. The centrifugal pump assembly 408 is substantially similar to the centrifugal pump assembly 116 described above with reference to FIG. 1, FIG. 2, FIG. 3A, FIG. 3B, FIG. 3C, FIG. 3D, FIG. 3E, FIG. 4A, FIG. 4B FIG. 4C, FIG. 5A, FIG. 5B, FIG. 5C, FIG. 6, FIG. 7, and FIG. 8. For example, the centrifugal pump assembly 408 comprises a plurality of pump stages, where each pump stage comprises an impeller coupled to a drive shaft of the centrifugal pump assembly 408 and a diffuser that is retained by a housing of the centrifugal pump assembly 408. The diffusers of the centrifugal pump assembly 408 have one or more of the novel vane structures described above—truncated vane 192, truncated vane 194, truncated vane 196, and or axial vane 212 (e.g., a ring vane).

The motor 402 may be an electric motor, a hydraulic turbine, or an air turbine. When the motor 402 turns, the drive shaft of the centrifugal pump assembly 408 turns, turning the impellers of the centrifugal pump assembly 408.

The torque provided by the motor 402 is transferred via the rotational coupling 404 to the drive shaft of the centrifugal pump assembly 408.

The HSP 400 may be applied for use in a variety of different surface operations. The HSP 400 can be used as a crude oil pipeline pressure and/or flow booster. The HSP 400 can be used in a mine dewatering operation (e.g., removing water from a mine). The HSP 400 can be used in geothermal energy applications, for example to pump geothermal water from a wellhead through a pipe to an end-use or energy conversion facility. The HSP 400 can be used in carbon sequestration operations. The HSP 400 can be used in salt water disposal operations, for example receiving salt water from a wellbore and pumping the salt water under pressure down into a disposal well. The HSP 400 can be used in desalinization operations. In any of these surface pumping applications, the novel diffuser structures taught above can advantageously be applied to increase the efficiency of the centrifugal pump assembly 408, to increase the head and/or flow rate produced by the centrifugal pump assembly 408, and/or increase the service life of the centrifugal pump assembly.

Additional Embodiments

The following are non-limiting, specific embodiments in accordance with the present disclosure:

A first embodiment, which is a horizontal pumping system (HPS) comprising a motor comprising a first drive shaft; and a centrifugal pump assembly comprising a second drive shaft that is coupled directly or indirectly to the first drive shaft of the motor and a plurality of pump stages, wherein each pump stage comprises an impeller coupled to the second drive shaft and a diffuser retained by a housing of the centrifugal pump assembly, wherein the diffuser of each pump stage comprises a first plurality of vanes each having a first axial length and a second plurality of vanes each disposed between a pair of vanes of the first plurality of vanes and each having a second axial length, wherein the second axial length is between three quarters (¾) of the first axial length and one quarter (¼) of the first axial length.

A second embodiment, which is the HPS of the first embodiment, wherein the first plurality of vanes of each of the diffusers are spaced about equal angular distances apart from each other.

A third embodiment, which is the HPS of the second embodiment, wherein the second plurality of vanes of each of the diffusers are each spaced about equal angular distances from the pair of vanes of the first plurality of vane it is disposed between.

A fourth embodiment, which is the HPS of the second embodiment wherein each of the second plurality of vanes spaced a closer distance from one adjacent vane of the first plurality of vanes and spaced a further angular distance from another adjacent vane of the first plurality of vanes.

A fifth embodiment, which is the HPS of any of the first through the fourth embodiment, wherein each of the diffusers further comprises a ring vane defining a solid of revolution about concentric with a centerline of the diffuser.

A sixth embodiment, which is the HPS of the fifth embodiment, wherein the ring vane of each of the diffusers has an axial length of between three quarters (¾) of the first axial length and one quarter (¼) of the first axial length.

A seventh embodiment, which is the HPS of the fifth embodiment, wherein the ring vane is spaced about an equal distance from a hub of the diffuser and from a shroud of the diffuser.

An eighth embodiment, which is the HPS of the fifth embodiment, wherein the ring vane is spaced closer to a hub of the diffuser than to a shroud of the diffuser s spaced closer to the shroud of the diffuser than to the hub of the diffuser.

A ninth embodiment, which is the HPS of any of the first through the eight embodiment, wherein each of the diffusers comprises a third plurality of vanes each disposed between one of the vanes of the first plurality of vanes and one of the vanes of the second plurality of vanes, wherein an axial length of each of the third plurality of vanes is less than the second axial length.

A tenth embodiment, which is the HPS of any of the first through the ninth embodiment, wherein for each of the diffusers, the trailing edges of each of the second plurality of vanes is located at about a same uphole location as the trailing edges of each of the first plurality of vanes and wherein the leading edges of each of the second plurality of vanes is located uphole of the leading edges of each of the first plurality of vanes.

An eleventh embodiment, which is the HPS of any of the first through the tenth embodiment, wherein for each of the diffusers, a first side of each of the first plurality of vanes is concave and an opposite side of each of the first plurality of vanes is convex.

A twelfth embodiment, which is the HPS of any of the first through the eleventh embodiment, wherein the HPS is used in a crude oil pipeline booster application.

A thirteenth embodiment, which is the HPS of any of the first through the eleventh embodiment, wherein the HPS is used in a mine dewatering application.

A fourteenth embodiment, which is the HPS of any of the first through the eleventh embodiment, wherein the HPS is used in a geothermal application.

A fifteenth embodiment, which is the HPS of any of the first through the eleventh embodiment, wherein the HPS is used in a carbon sequestration application.

A sixteenth embodiment, which is the HPS of any of the first through the eleventh embodiment, wherein the HPS is used in a salt water disposal application.

A seventeenth embodiment, which is the HPS of any of the first through the eleventh embodiment, wherein the HPS is used in a desalinization application.

An eighteenth embodiment, which is the HPS of any of the first through the seventeenth embodiment, wherein the motor is an electric motor.

A nineteenth embodiment, which is the HPS of any of the first through the seventeenth embodiment, wherein the motor is a hydraulic turbine motor.

A twentieth embodiment, which is the HPS of any of the first through the seventeenth embodiment, wherein the motor is an air turbine motor.

A twenty-first embodiment, which is a method of pumping a fluid, comprising installing a horizontal pump system (HPS) at a surface location, wherein the HPS comprises a motor and a centrifugal pump assembly, wherein the centrifugal pump assembly comprises a drive shaft and a plurality of pump stages, wherein each pump stage comprises an impeller coupled to the drive shaft and a diffuser retained stationary within the centrifugal pump assembly, wherein each diffuser comprises a first plurality of vanes each having a first axial length and a second plurality of vanes each disposed between a pair of vanes of the first plurality of vanes and each having a second axial length, wherein the second axial length is between three quarters (¾) of the first axial length and one quarter (¼) of the first axial length; providing rotating power by the motor to the drive shaft of the centrifugal pump; receiving the fluid into a fluid inlet at a first end of the centrifugal pump assembly; flowing the fluid between each of the first plurality of vanes of each of the diffusers; splitting the fluid flowing between the first plurality of vanes by each of the second plurality of vanes of each of the diffusers; and flowing the fluid out a fluid outlet at a second end of the centrifugal pump assembly.

A twenty-second embodiment, which is the method of the twenty-first embodiment, wherein each diffuser comprises a third plurality of vanes each having a third axial length, wherein the third axial length is less than the second axial length and wherein each of the third plurality of vanes is disposed between one of the vanes of the first plurality of vanes and one of the vanes of the second plurality of vanes, further comprising splitting the fluid flowing between the first plurality of vanes and the second plurality of vanes by each of the third plurality of vanes.

A twenty-third embodiment, which is the method of the twenty-first or the twenty-second embodiment, wherein each diffuser comprises a ring vane disposed between an outside of a hub structure of the diffuser and an inside of a shroud structure of the diffuser, further comprising splitting the fluid flowing between the outside of the hub structure of the diffuser and the inside of the shroud structure by the by the ring vane.

A twenty-fourth embodiment, which is the method of any of the twenty-first through the twenty-third embodiment, wherein a trailing edge of each of the second plurality of vanes is located at about a same uphole location as a trailing edge of each of the first plurality of vanes and wherein a leading edge of each of the second plurality of vanes is located uphole of a leading edge of each of the first plurality of vanes.

A twenty-fifth embodiment, which is the method of any of the twenty-first through the twenty-fourth embodiment, wherein the second axial length is about two thirds (⅔) of the first axial length.

A twenty-sixth embodiment, which is the method of any of the twenty-first through the twenty-fifth embodiment, wherein splitting the fluid flowing between the first plurality of vanes by each of the second plurality of vanes of each of the diffusers prevents separation of the fluid proximate the surfaces of the first plurality of vanes.

A twenty-seventh embodiment, which is the method of any of the twenty-first through the twenty-sixth embodiment, wherein the HPS is used in a crude oil pipeline booster application.

A twenty-eighth embodiment, which is the method of any of the twenty-first through the twenty-sixth embodiment, wherein the HPS is used in a mine dewatering application.

A twenty-ninth embodiment, which is the method of any of the twenty-first through the twenty-sixth embodiment, wherein the HPS is used in a geothermal application.

A thirtieth embodiment, which is the method of any of the twenty-first through the twenty-fifth embodiment, wherein the HPS is used in a carbon sequestration application.

A thirty-first embodiment, which is the method of any of the twenty-first through the twenty-fifth embodiment, wherein the HPS is used in a salt water disposal application.

A thirty-second embodiment, which is the method of any of the twenty-first through the twenty-fifth embodiment, wherein the HPS is used in a desalinization application.

A thirty-third embodiment, which is the method of any of the twenty-first through the thirty-second embodiment, wherein the motor is an electric motor.

A thirty-fourth embodiment, which is the method of any of the twenty-first through the thirty-second embodiment, wherein the motor is a hydraulic turbine motor.

A thirty-fifth embodiment, which is the method of any of the twenty-first through the thirty-second embodiment, wherein the motor is an air turbine motor.

A thirty-sixth embodiment, which is a method of pumping a fluid, comprising installing a horizontal pump system (HPS) comprising a motor and a centrifugal pump assembly according to any of the first through the twentieth embodiment at a surface location; providing rotating power by the motor to the drive shaft of the centrifugal pump; receiving the fluid into a fluid inlet at a first end of the centrifugal pump assembly; flowing the fluid between each of the first plurality of vanes of each of the diffusers; splitting the fluid flowing between the first plurality of vanes by each of the second plurality of vanes of each of the diffusers; and flowing the fluid out a fluid outlet at a second end of the centrifugal pump assembly.

A thirty-seventh embodiment, which is a submersible pump assembly comprising a motor comprising a first drive shaft; a seal section comprising a second drive shaft that is coupled to the first drive shaft of the motor; and a centrifugal pump assembly comprising a third drive shaft that is coupled directly or indirectly to the second drive shaft of the seal section and a plurality of pump stages, wherein each pump stage comprises an impeller coupled to the third drive shaft and a diffuser retained by a housing of the centrifugal pump assembly, wherein the diffuser of each pump stage comprises a first plurality of vanes each having a first axial length and a second plurality of vanes each disposed between a pair of vanes of the first plurality of vanes and each having a second axial length, wherein the second axial length is between three quarters (¾) of the first axial length and one quarter (¼) of the first axial length.

A thirty-eighth embodiment, which is the submersible pump assembly of the thirty-seventh embodiment, wherein the first plurality of vanes of each of the diffusers are spaced about equal angular distances apart from each other.

A thirty-ninth embodiment, which is the submersible pump assembly of the thirty-eighth embodiment, wherein the second plurality of vanes of each of the diffusers are each spaced about equal angular distances from the pair of vanes of the first plurality of vane it is disposed between.

A fortieth embodiment, which is the submersible pump assembly of the thirty-eighth embodiment, wherein each of the second plurality of vanes is spaced a closer angular distance from one adjacent vane of the first plurality of vanes and spaced a further angular distance from another adjacent vane of the first plurality of vanes.

A forty-first embodiment, which is the submersible pump assembly of any of the thirty-seventh through the fortieth embodiment, wherein each of the diffusers further comprises a ring vane defining a solid of revolution about concentric with a centerline of the diffuser.

A forty-second embodiment, which is the submersible pump assembly of the forty-first embodiment wherein the ring vane of each of the diffusers has an axial length of between three quarters (¾) of the first axial length and one quarter (¼) of the first axial length.

A forty-third embodiment, which is the submersible pump assembly of the forty-first embodiment, wherein the ring vane is spaced about an equal distance from a hub of the diffuser and from a shroud of the diffuser.

A forty-fourth embodiment, which is the submersible pump assembly of the forty-first embodiment, wherein the ring vane is spaced closer to a hub of the diffuser than to a shroud of the diffuser or is spaced closer to the shroud of the diffuser than to the hub of the diffuser.

A forty-fifth embodiment, which is the submersible pump assembly of any of the thirty-seventh through the forty-fourth embodiment, wherein each of the diffusers comprises a third plurality of vanes each disposed between one of the vanes of the first plurality of vanes and one of the vanes of the second plurality of vanes, wherein an axial length of each of the third plurality of vanes is less than the second axial length.

A forty-sixth embodiment, which is the submersible pump assembly of any of the thirty-seventh through the forty-fifth embodiment, wherein for each of the diffusers, the trailing edges of each of the second plurality of vanes is located at about a same uphole location as the trailing edges of each of the first plurality of vanes and wherein the leading edges of each of the second plurality of vanes is located uphole of the leading edges of each of the first plurality of vanes.

A forty-seventh embodiment, which is the submersible pump assembly of any of the thirty-seventh through the forty-sixth embodiment, wherein for each of the diffusers, a first side of each of the first plurality of vanes is concave and an opposite side of each of the first plurality of vanes is convex.

A forty-eighth embodiment, which is the submersible pump assembly of any of the thirty-seventh through the forty-seventh embodiment, wherein the motor is an electric motor, a hydraulic turbine motor, or a pneumatic turbine motor.

A forty-ninth embodiment, which is a method of lifting well fluid to a surface, comprising running a submersible pump assembly into a wellbore, wherein the submersible pump assembly comprises a motor and a centrifugal pump assembly, wherein the centrifugal pump assembly comprises a drive shaft and a plurality of pump stages, wherein each pump stage comprises an impeller coupled to the drive shaft and a diffuser retained stationary within the centrifugal pump assembly, wherein each diffuser comprises a first plurality of vanes each having a first axial length and a second plurality of vanes each disposed between a pair of vanes of the first plurality of vanes and each having a second axial length, wherein the second axial length is between three quarters (¾) of the first axial length and one quarter (¼) of the first axial length; providing power to the motor; providing rotating power by the motor to the drive shaft of the centrifugal pump; receiving the well fluid into an inlet at a downhole end of the centrifugal pump assembly; flowing the well fluid between each of the first plurality of vanes of each of the diffusers; splitting the well fluid flowing between the first plurality of vanes by each of the second plurality of vanes of each of the diffusers; and flowing the well fluid out an outlet at an uphole end of the centrifugal pump assembly.

A fiftieth embodiment, which is the method of the forty-ninth embodiment, wherein each diffuser comprises a third plurality of vanes each having a third axial length, wherein the third axial length is less than the second axial length and wherein each of the third plurality of vanes is disposed between one of the vanes of the first plurality of vanes and one of the vanes of the second plurality of vanes, further comprising splitting the well fluid flowing between the first plurality of vanes and the second plurality of vanes by each of the third plurality of vanes.

A fifty-first embodiment, which is the method of the forty-ninth or the fiftieth embodiment, wherein each diffuser comprises a ring vane disposed between an outside of a hub structure of the diffuser and an inside of a shroud structure of the diffuser, further comprising splitting the well fluid flowing between the outside of the hub structure of the diffuser and the inside of the shroud structure by the by the ring vane.

A fifty-second embodiment, which is the method of any of the forty-ninth through the fifty-first embodiment, wherein a trailing edge of each of the second plurality of vanes is located at about a same uphole location as a trailing edge of each of the first plurality of vanes and wherein a leading edge of each of the second plurality of vanes is located uphole of a leading edge of each of the first plurality of vanes.

A fifty-third embodiment, which is the method of any of the forty-ninth through the fifty-second embodiment, wherein the second axial length is about two thirds (⅔) of the first axial length.

A fifty-fourth embodiment, which is the method of any of the forty-ninth through the fifty-third embodiment, wherein splitting the well fluid flowing between the first plurality of vanes by each of the second plurality of vanes of each of the diffusers prevents separation of the well fluid proximate the surfaces of the first plurality of vanes.

A fifty-fifth embodiment, which is a method of assembling a centrifugal pump assembly comprising installing a plurality of pump stages onto a drive shaft, wherein each pump stage comprises an impeller coupled to the drive shaft and a diffuser, wherein each diffuser comprises a first plurality of vanes each having a first axial length and a second plurality of vanes each disposed between a pair of vanes of the first plurality of vanes and each having a second axial length, wherein the second axial length is between three quarters (¾) of the first axial length and one quarter (¼) of the first axial length; installing a housing over the plurality of pump stages, wherein the housing retains each of the diffusers; coupling a base to a downhole end of the centrifugal pump assembly; and coupling a pump discharge to an uphole end of the centrifugal pump assembly.

A fifty-sixth embodiment, which is the method of the fifty-fifth embodiment, wherein each of the diffusers has a ring vane that is approximately concentric with a centerline of the diffuser.

A fifty-seventh embodiment, which is the method of the fifty-fifth or the fifty-sixth embodiment, wherein each of the diffusers comprises a third plurality of vanes each disposed between one of the vanes of the first plurality of vanes and one of the vanes of the second plurality of vanes, wherein an axial length of each of the third plurality of vanes is less than the second axial length.

A fifty-eighth embodiment, which is the method of the fifty-seventh embodiment, wherein each of the diffusers has a ring vane that is approximately concentric with a centerline of the diffuser.

A fifty-ninth embodiment, which is the method of any of the fifty-fifth through the fifty-eighth embodiment, wherein for each of the diffusers, the trailing edges of each of the second plurality of vanes is located at about a same uphole location as the trailing edges of each of the first plurality of vanes and wherein the leading edges of each of the second plurality of vanes is located uphole of the leading edges of each of the first plurality of vanes.

A sixtieth embodiment, which is the method of any of the fifty-fifth through the fifty-ninth embodiment, wherein for each of the diffusers, a first side of each of the first plurality of vanes is concave and an opposite side of each of the first plurality of vanes is convex.

A sixty-first embodiment, which is an electric submersible pump (ESP) assembly comprising an electric motor comprising a first drive shaft; a seal section comprising a second drive shaft that is coupled to the first drive shaft of the electric motor; and a centrifugal pump assembly comprising a third drive shaft that is coupled directly or indirectly to the second drive shaft of the seal section and a plurality of pump stages, wherein each pump stage comprises an impeller coupled to the third drive shaft and a diffuser retained by a housing of the centrifugal pump assembly, wherein the diffuser of each pump stage comprises a first plurality of vanes each having a first axial length and a second plurality of vanes each disposed between a pair of vanes of the first plurality of vanes and each having a second axial length, wherein the second axial length is between three quarters (¾) of the first axial length and one quarter (¼) of the first axial length.

A sixty-second embodiment, which is the ESP assembly of the sixty-first embodiment, wherein the first plurality of vanes of each of the diffusers are spaced about equal angular distances apart from each other.

A sixty-third embodiment, which is the ESP assembly of the sixty-second embodiment, wherein the second plurality of vanes of each of the diffusers are each spaced about equal angular distances from the pair of vanes of the first plurality of vane it is disposed between.

A sixty-fourth embodiment, which is the ESP assembly of any of the sixty-first through the sixty-third embodiment, wherein each of the diffusers further comprises a ring vane defining a solid of revolution about concentric with a centerline of the diffuser.

A sixty-fifth embodiment, which is the ESP assembly of the sixty-fourth embodiment, wherein the ring vane of each of the diffusers has an axial length of between three quarters (¾) of the first axial length and one quarter (¼) of the first axial length.

A sixty-sixth embodiment, which is the ESP assembly of any of the sixty-first through the sixty-fifth embodiment, wherein each of the diffusers comprises a third plurality of vanes each disposed between one of the vanes of the first plurality of vanes and one of the vanes of the second plurality of vanes, wherein an axial length of each of the third plurality of vanes is less than the second axial length.

A sixty-seventh embodiment, which is the ESP assembly of any of the sixty-first through the sixty-sixth embodiment, wherein for each of the diffusers, the trailing edges of each of the second plurality of vanes located at about a same uphole location as the trailing edges of each of the first plurality of vanes and wherein the leading edges of each of the second plurality of vanes is located uphole of the leading edges of each of the first plurality of vanes.

A sixty-eighth embodiment, which is the ESP assembly of any of the sixty-first through the sixty-seventh embodiment, wherein for each of the diffusers, a first side of each of the first plurality of vanes is concave and an opposite side of each of the first plurality of vanes is convex.

A sixty-ninth embodiment, which is a method of lifting well fluid to a surface comprising running an electric submersible pump (ESP) assembly into a wellbore, wherein the ESP assembly comprises an electric motor and a centrifugal pump assembly, wherein the centrifugal pump assembly comprises a drive shaft and a plurality of pump stages, wherein each pump stage comprises an impeller coupled to the drive shaft and a diffuser retained stationary within the centrifugal pump assembly, wherein each diffuser comprises a first plurality of vanes each having a first axial length and a second plurality of vanes each disposed between a pair of vanes of the first plurality of vanes and each having a second axial length, wherein the second axial length is between three quarters (¾) of the first axial length and one quarter (¼) of the first axial length; providing electric power to the electric motor; providing rotating power by the electric motor to the drive shaft of the centrifugal pump; receiving the well fluid into an inlet at a downhole end of the centrifugal pump assembly; flowing the well fluid between each of the first plurality of vanes of each of the diffusers; splitting the well fluid flowing between the first plurality of vanes by each of the second plurality of vanes of each of the diffusers; and flowing the well fluid out an outlet at an uphole end of the centrifugal pump assembly.

A seventieth embodiment, which is the method of the sixty-ninth embodiment, wherein each diffuser comprises a third plurality of vanes each having a third axial length, wherein the third axial length is less than the second axial length and wherein each of the third plurality of vanes is disposed between one of the vanes of the first plurality of vanes and one of the vanes of the second plurality of vanes, further comprising splitting the well fluid flowing between the first plurality of vanes and the second plurality of vanes by each of the third plurality of vanes.

A seventy-first embodiment, which is the method of the sixty-ninth or the seventieth embodiment, wherein each diffuser comprises a ring vane disposed between an outside of a hub structure of the diffuser and an inside of a shroud structure of the diffuser, further comprising splitting the well fluid flowing between the outside of the hub structure of the diffuser and the inside of the shroud structure by the by the ring vane.

A seventy-second embodiment, which is the method of any of the sixty-ninth through the seventy-first embodiment, wherein a trailing edge of each of the second plurality of vanes is located at about a same uphole location as a trailing edge of each of the first plurality of vanes and wherein a leading edge of each of the second plurality of vanes is located uphole of a leading edge of each of the first plurality of vanes.

A seventy-third embodiment, which is the method of any of the sixty-ninth through the seventy-second embodiment, wherein the second axial length is about two thirds (⅔) of the first axial length.

A seventy-fourth embodiment, which is the method of any of the sixty-ninth through the seventy-third embodiment, wherein splitting the well fluid flowing between the first plurality of vanes by each of the second plurality of vanes of each of the diffusers prevents separation of the well fluid proximate the surfaces of the first plurality of vanes.

A seventy-fifth embodiment, which is a method of assembling a centrifugal pump assembly comprising installing a plurality of pump stages onto a drive shaft, wherein each pump stage comprises an impeller coupled to the drive shaft and a diffuser, wherein each diffuser comprises a first plurality of vanes each having a first axial length and a second plurality of vanes each disposed between a pair of vanes of the first plurality of vanes and each having a second axial length, wherein the second axial length is between three quarters (¾) of the first axial length and one quarter (¼) of the first axial length; installing a housing over the plurality of pump stages, wherein the housing retains each of the diffusers; coupling a base to a downhole end of the centrifugal pump assembly; and coupling a pump discharge to an uphole end of the centrifugal pump assembly.

A seventy-sixth embodiment, which is the method of the seventy-fifth embodiment, wherein each of the diffusers has a ring vane that is approximately concentric with a centerline of the diffuser.

A seventy-seventh embodiment, which is the method of the seventy-fifth or the seventy-sixth embodiment, wherein each of the diffusers comprises a third plurality of vanes each disposed between one of the vanes of the first plurality of vanes and one of the vanes of the second plurality of vanes, wherein an axial length of each of the third plurality of vanes is less than the second axial length.

A seventy-eighth embodiment, which is the method of the seventy-seventh embodiment, wherein each of the diffusers has a ring vane that is approximately concentric with a centerline of the diffuser.

A seventy-ninth embodiment, which is the method of the seventy-fifth through the seventy-eight embodiment, wherein for each of the diffusers, the trailing edges of each of the second plurality of vanes is located at about a same uphole location as the trailing edges of each of the first plurality of vanes and wherein the leading edges of each of the second plurality of vanes is located uphole of the leading edges of each of the first plurality of vanes.

An eightieth embodiment, which is the method of any of the seventy-fifth through the seventy-ninth embodiment, wherein for each of the diffusers, a first side of each of the first plurality of vanes is concave and an opposite side of each of the first plurality of vanes is convex.

An eightieth embodiment, which is the submersible pump assembly of the forty-first embodiment, wherein the ring vane is spaced away from the hub a distance of between one fifth and two fifths of the radial distance between the hub and shroud.

An eighty-first embodiment, which is the submersible pump assembly of the forty-first embodiment, wherein the ring vane is spaced away from the hub a distance of between three fifths and four fifths of the radial distance between the hub and shroud.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent 51 percent, 52 percent, 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A submersible pump assembly, comprising:

a motor comprising a first drive shaft;

a seal section comprising a second drive shaft that is coupled to the first drive shaft of the motor; and a centrifugal pump assembly comprising a third drive shaft that is coupled directly or indirectly to the second drive shaft of the seal section and a plurality of pump stages, wherein each pump stage comprises an impeller coupled to the third drive shaft and a diffuser retained by a housing of the centrifugal pump assembly, wherein the diffuser of each pump stage comprises a first plurality of vanes each having a first axial length and a second plurality of vanes each disposed between a pair of vanes of the first plurality of vanes and each having a second axial length, wherein the second axial length is between three quarters (¾) of the first axial length and one quarter (¼) of the first axial length, wherein the first axial length and the second axial length extend in the direction of a centerline axis of the diffuser and wherein the centerline axis of the diffuser is coincident with a centerline axis of the centrifugal pump assembly.

2. The submersible pump assembly of claim 1, wherein the first plurality of vanes of each of the diffusers are spaced about equal angular distances apart from each other.

3. The submersible pump assembly of claim 2, wherein the second plurality of vanes of each of the diffusers are each spaced about equal angular distances from the pair of vanes of the first plurality of vane it is disposed between.

4. The submersible pump assembly of claim 2, wherein each of the second plurality of vanes is spaced a closer angular distance from one adjacent vane of the first plurality of vanes and spaced a further angular distance from another adjacent vane of the first plurality of vanes.

5. The submersible pump assembly of claim 1, wherein each of the diffusers further comprises a ring vane defining a solid of revolution about concentric with a centerline of the diffuser.

6. The submersible pump assembly of claim 5, wherein the ring vane of each of the diffusers has an axial length of between three quarters (¾) of the first axial length and one quarter (¼) of the first axial length.

7. The submersible pump assembly of claim 5, wherein the ring vane is spaced about an equal distance from a hub of the diffuser and from a shroud of the diffuser.

8. The submersible pump assembly of claim 5, wherein the ring vane is spaced closer to a hub of the diffuser than to a shroud of the diffuser or is spaced closer to the shroud of the diffuser than to the hub of the diffuser.

9. The submersible pump assembly of claim 1, wherein each of the diffusers comprises a third plurality of vanes each disposed between one of the vanes of the first plurality of vanes and one of the vanes of the second plurality of vanes, wherein an axial length of each of the third plurality of vanes is less than the second axial length.

10. The submersible pump assembly of claim 1, wherein for each of the diffusers, a trailing edge of each of the second plurality of vanes is located at about a same uphole location as the trailing edges of each of the first plurality of vanes and wherein the leading edges of each of the second plurality of vanes is located uphole of the leading edges of each of the first plurality of vanes.

11. The submersible pump assembly of claim 1, wherein for each of the diffusers, a first side of each of the first plurality of vanes is concave and an opposite side of each of the first plurality of vanes is convex.

12. The submersible pump assembly of claim 1, wherein the motor is an electric motor, a hydraulic turbine motor, or a pneumatic turbine motor.

13. A method of lifting well fluid to a surface, comprising:

running a submersible pump assembly into a wellbore, wherein the submersible pump assembly comprises a motor and a centrifugal pump assembly, wherein the centrifugal pump assembly comprises a drive shaft and a plurality of pump stages, wherein each pump stage comprises an impeller coupled to the drive shaft and a diffuser retained stationary within the centrifugal pump assembly, wherein each diffuser comprises a first plurality of vanes each having a first axial length and a second plurality of vanes each disposed between a pair of vanes of the first plurality of vanes and each having a second axial length, wherein the second axial length is between three quarters (¾) of the first axial length and one quarter (¼) of the first axial length, wherein the first axial length and the second axial length extend in the direction of a centerline axis of symmetry of the diffuser and wherein the centerline axis of symmetry of the diffuser is coincident with a centerline axis of the centrifugal pump assembly;

providing power to the motor;

providing rotating power by the motor to the drive shaft of the centrifugal pump;

receiving the well fluid into an inlet at a downhole end of the centrifugal pump assembly;

flowing the well fluid between each of the first plurality of vanes of each of the diffusers;

splitting the well fluid flowing between the first plurality of vanes by each of the second plurality of vanes of each of the diffusers; and flowing the well fluid out an outlet at an uphole end of the centrifugal pump assembly.

14. The method of claim 13, wherein each diffuser comprises a third plurality of vanes each having a third axial length, wherein the third axial length is less than the second axial length and wherein each of the third plurality of vanes is disposed between one of the vanes of the first plurality of vanes and one of the vanes of the second plurality of vanes, further comprising splitting the well fluid flowing between the first plurality of vanes and the second plurality of vanes by each of the third plurality of vanes.

15. The method of claim 13, wherein each diffuser comprises a ring vane disposed between an outside of a hub structure of the diffuser and an inside of a shroud structure of the diffuser, further comprising splitting the well fluid flowing between the outside of the hub structure of the diffuser and the inside of the shroud structure by the by the ring vane.

16. The method of claim 13, wherein a trailing edge of each of the second plurality of vanes is located at about a same uphole location as a trailing edge of each of the first plurality of vanes and wherein a leading edge of each of the second plurality of vanes is located uphole of a leading edge of each of the first plurality of vanes.

17. The method of claim 13, wherein the second axial length is about two thirds (⅔) of the first axial length.

18. The method of claim 13, wherein splitting the well fluid flowing between the first plurality of vanes by each of the second plurality of vanes of each of the diffusers prevents separation of the well fluid proximate the surfaces of the first plurality of vanes.

19. A method of assembling a centrifugal pump assembly, comprising:

installing a plurality of pump stages onto a drive shaft, wherein each pump stage comprises an impeller coupled to the drive shaft and a diffuser, wherein each diffuser comprises a first plurality of vanes each having a first axial length and a second plurality of vanes each disposed between a pair of vanes of the first plurality of vanes and each having a second axial length, wherein the second axial length is between three quarters (¾) of the first axial length and one quarter (¼) of the first axial length, wherein the first axial length and the second axial length extend in the direction of a centerline axis of symmetry of the diffuser and wherein the centerline axis of symmetry of the diffuser is coincident with a centerline axis of the centrifugal pump assembly;

installing a housing over the plurality of pump stages, wherein the housing retains each of the diffusers;

coupling a base to a downhole end of the centrifugal pump assembly; and coupling a pump discharge to an uphole end of the centrifugal pump assembly.

20. The method of claim 19, wherein each of the diffusers has a ring vane that is concentric with a centerline of the diffuser.

21. The method of claim 19, wherein each of the diffusers comprises a third plurality of vanes each disposed between one of the vanes of the first plurality of vanes and one of the vanes of the second plurality of vanes, wherein an axial length of each of the third plurality of vanes is less than the second axial length.

22. The method of claim 21, wherein each of the diffusers has a ring vane that is approximately concentric with a centerline of the diffuser.

23. The method of claim 19, wherein for each of the diffusers, a trailing edge of each of the second plurality of vanes is located at about a same uphole location as the trailing edges of each of the first plurality of vanes and wherein the leading edges of each of the second plurality of vanes is located uphole of the leading edges of each of the first plurality of vanes.

24. The method of claim 19, wherein for each of the diffusers, a first side of each of the first plurality of vanes is concave and an opposite side of each of the first plurality of vanes is convex.

* * * * *